US008347586B2

(12) United States Patent
Boldt

(10) Patent No.: US 8,347,586 B2
(45) Date of Patent: Jan. 8, 2013

(54) WINDOW AND DOOR ASSEMBLY STRUCTURES

(75) Inventor: Gary L. Boldt, Green Bay, WI (US)

(73) Assignee: Bay Industries, Inc., Green Bay, WI (US)

( * ) Notice: Subject to any disclaimer, the term of this patent is extended or adjusted under 35 U.S.C. 154(b) by 372 days.

(21) Appl. No.: 12/590,375

(22) Filed: Nov. 6, 2009

(65) Prior Publication Data

US 2011/0107694 A1 May 12, 2011

(51) Int. Cl.
*E04B 1/00* (2006.01)

(52) U.S. Cl. ..... 52/745.16; 52/204.53; 52/210; 52/211; 52/656.5

(58) Field of Classification Search ..... 52/204, 52/205, 210–213, 462, 656.5, 745.15, 745.16, 52/204.53

See application file for complete search history.

(56) References Cited

U.S. PATENT DOCUMENTS

| | | | |
|---|---|---|---|
| 3,690,082 | A | 9/1972 | Byland |
| 4,505,080 | A | 3/1985 | Sailor |
| 4,924,631 | A | 5/1990 | Davies et al. |
| 5,058,323 | A | 10/1991 | Gerritsen |
| 5,070,651 | A | 12/1991 | Jeter |
| 5,199,234 | A | 4/1993 | Guhl |
| 5,722,207 | A | 3/1998 | Anderson et al. |
| 5,758,458 | A | 6/1998 | Ridge |
| 6,223,484 | B1 | 5/2001 | Minter |
| 6,343,438 | B1 | 2/2002 | Boldt |
| 6,568,137 | B2 | 5/2003 | Ballantyne |
| 6,745,523 | B2 | 6/2004 | Petta |
| 7,111,433 | B2 | 9/2006 | Kerscher |
| 7,284,353 | B2 | 10/2007 | Bealko |
| 2007/0074469 | A1 | 4/2007 | Plagemann et al. |

OTHER PUBLICATIONS

Tecton Products LLC, Products Tecton Door System, www.tectonproducts.com/, Printed Mar. 27, 2006, 11 pages.
Frontline Bldg. Products, Clad Overhead Door Frames, Brochure, Copyrighted 1996, 2 pages.
Frontline Bldg. Products, Clad Entry Door Systems, Brochure, Copyrighted 1996, 2 pages.
Frontline Bldg. Products, Aluminum Clad Garage Door Frame, Copyrighted 1998, 2 pages.

*Primary Examiner* — William Gilbert
(74) *Attorney, Agent, or Firm* — Thomas D. Wilhelm; Wilhelm Law, S.C.

(57) ABSTRACT

Interfaces between nosings on respective frames and frame combinations to be joined. Each nosing has an elongate receptacle extending along the nosing length. A remote wall of the receptacle is displaced from the remainder of the nosing. The remote wall on the nosings to be joined can be generally aligned with and proximate the receptacle opening on the other nosing. With the remote walls and respective receptacles aligned, the frames are moved toward each other with the remote walls on the respective nosings entering the receptacles, with the remote walls in generally facing relationship with each other. Spacings and tolerances of the remote walls, and corresponding receptacles, can optionally provide frictionally-restrained engagements of the remote walls in the receptacles, whereby the frames can be re-oriented with limited assembly support to such assembly without disengagement of the nosings from each other by the action of gravity.

36 Claims, 12 Drawing Sheets

WINDOW AND DOOR ASSEMBLY STRUCTURES

BACKGROUND OF THE INVENTION

This invention relates in general to clad windows and clad personnel entry doors. This invention relates especially to clad door frames which are used in buildings as avenues for people entering and exiting the building, including door assemblies wherein windows are joined to such door frames either as side lites or as overhead transom windows. This invention also relates to overlying clad transom windows used in clad door assemblies. The invention further relates to joining clad window frames to each other, to joining clad door frames to each other, and to joining clad window frames and clad door frames to each other.

Arcuate windows, overlying e.g. a rectangular window, or overlying a door, have achieved an established position in the market for windows and doors. Arcuate windows can provide a desired aesthetic/artistic characteristic to the overall appearance of a building.

Penetration of water into window frames is known as a significant source of deterioration/damage in window frames which use wood as a structural and/or decorative material.

Advances have been made in the fabrication of the arcuate portions of window framing from wood, and in the fabrication of glazing units from glass or other sheet material, for such windows. The nosing portion of the cladding which attaches to the structural window framing is desirably made of a material which is more weather-resistant than wood in order to avoid frequent maintenance to the outside surface of the window structure and to reduce the amount of water which penetrates the window, thereby reaching the wood substrate and causing deterioration of the wood substrate.

Doors and windows are generally assembled by an assembler. The assembler incorporates the respective door slab in a door frame and the respective window glazing in a window frame. As desired, window clusters may be assembled in a single window frame which extends about the outer perimeter of the cluster, and side light windows may be assembled to a door frame.

A window which is located directly over a door or door/sidelight combination is commonly referred to as a transom window. Transom windows are desirably assembled into a common unit with the respective underlying door frame so that the combined structure can be inserted, as a single unit, into the rough opening in the building.

However, the industry has not to date provided adequate interface structure which facilitates easily joining the transom window frame to an underlying door frame during assembly of the transom window to the underlying door frame.

Ongoing advances in development of window and door frames have moved toward extruded aluminum and extruded plastics as materials of choice to face the ambient environment on the outside surface of the building. Extruded aluminum and extruded plastics require only limited maintenance.

Transom windows, and windows in general, are conventionally fabricated in a wide variety of shapes. In some windows, all of the sides are straight. In other windows, some of the sides are arcuate or otherwise curvilinear as in conventional half-round and eyebrow windows. So, while it would be desirable to provide similarly-configured nosings and drip caps, extruded aluminum and extruded plastics, from which nosings and drip caps are commonly made, are typically fabricated in extended production runs as straight-line extrusions, whereby arcuate extrusions of such structures are not available as mass produced articles of commerce.

In some instances, it is desirable to attach an arcuate drip cap to an arcuate nosing, or to an arcuate portion of a nosing. In response to the desire for arcuate nosing material for arcuate windows, the industry has developed the technical capability to bend conventionally-fabricated straight-line rectangular nosing extrusions, without drip caps.

Thus, the industry offers an aluminum nosing which is extruded as a straight nosing. After being extruded as an elongate straight profile nosing, the aluminum nosing is bent to the desired arcuate configuration. In order to have an arcuate drip cap which can be used with such bent/arcuate nosing, a straight, extruded drip cap is separately bent into the desired arcuate shape. The lower surface of the platform of the so-bent drip cap is then positioned over the outer surface of the outer flange of the so-bent nosing, with the inner end of the drip cap in general alignment with the inner-facing web of the nosing. In conventional assemblies, there is no alignment structure in the drip cap or in the nosing which assists in holding the drip cap in alignment over the nosing, or which assists in mounting the drip cap to the nosing. Rather, the assembler places the drip cap on the nosing, and holds the drip cap in "X" and "Y" alignment with the nosing, while attaching the arcuately-formed drip cap to the arcuately-formed nosing, using screws spaced generally uniformly along the full length of the drip cap.

The first function of the screws is to attach the drip cap to the nosing. The second function of the screws is to maintain the alignment between the drip cap and the nosing. In addition, as the screws are tightened, the tightening of the screws acts to force the arcuate configuration of the drip cap and the arcuate configuration of the nosing to conform to each other whereby any variations in the angle or consistency of the arc radii of the drip cap and the nosing are desirably nullified as the drip cap and the nosing are drawn together by the tightening of the screws. In the event of a substantial misalignment of nosing and drip cap, or substantially different subtended arcs, extra tightening force may be used on the screws, along with corrective lateral alignment forces between the nosing and the drip cap, within the limits allowed by the screw holes, to attempt to conform the drip cap and nosing to each other. If too much force is used tightening a screw, the threads may be stripped, either on the screw or on the drip cap or on the nosing. If a user encounters excessive difficulty in assembling an assembly, including potential damage to the nosing or the drip cap, the drip cap or the nosing may be discarded in favor of a different piece, drip cap or nosing, which will, hopefully, be better suited for the desired assembly configuration, or will not be damaged during the assembly process. Even where the nosing and the drip cap are properly configured in terms of cooperative arcuate radii, and where the assembler does not strip any threads, the assembly of the two elements together, and their alignment, are completely dependent on use of acceptable gripping power, and structural integrity, relative to the assembly screws, which are maintained under constant stress. The stress on the screws in the assembly represents a combination of the tension normally needed to hold assembled parts in surface-to-surface contact with each other where both parts are in fact formed to the same arcuate configuration, as well as the tension needed to bend either the nosing or the drip cap, potentially along the full lengths of those parts, in order to correct inconsistencies in the arcuate configurations of the parts being assembled.

Further, the screws present a less-than-desirable appearance to the window framing. The screws tend to catch dirt; and the screws provide potential avenues for water to leak into the window structure. Further, the screws incur a certain labor cost while assembling the assembly. Overall, the screws are attended by a number of negative factors whereby it is desirable to reduce the number of screws which need to be used at locations where the screws are exposed to casual visual observation or where the screws are exposed to ambient weather.

In addition, the assembly process bears a certain risk of misalignment of the drip cap on the nosing. Namely, the worker who is assembling the drip cap to the nosing must ensure that the drip cap remains aligned with the nosing throughout the assembly process, until all of the screws are in place.

For conventional joining of clad window frames to clad door frames, or clad window frames to clad window frames, or clad door frames to clad door frames, the respective frames are typically aligned with each other with the assistance of a jig or other fixture which is not part of either frame. The frames are then secured to each other using fasteners such as screws or nails. A mullion cap or the like is then driven into the molding/nosing kerf receptacles thereby to cover the joint between the frames. Such mullion cap is employed for aesthetic/appearance purposes, and does not contribute significantly to the function of holding the frames secured together. Rather, the securement function is performed by the e.g. screws or nails or other fasteners external of the nosings.

SUMMARY

The invention is directed to frames and frame combinations, and especially to the interface between the nosings on respective frames which are to be joined. Each of the respective nosings has an elongate receptacle which extends along the length of the nosing. A remote wall of the receptacle is generally displaced from the remainder of the nosing. The nosings on respective frame members which are to be joined are configured such that the nosings can be aligned, with the remote wall on each nosing generally aligned with and proximate the receptacle opening on the other nosing. With the remote walls and receptacles so aligned, the frames are moved relative to each other such that the remote walls on the respective nosings enter the receptacles such that the remote walls are in generally facing relationship, generally overlying and underlying each other. The spacings and tolerances of the remote upper and lower walls of the nosings, and the corresponding receptacles are such that, once the remote walls are engaged in the receptacles, the engagements of the remote walls of the respective nosings in the respective receptacles are substantial frictional engagements. Thus, the nosings tend to remain engaged with each other even with modest handling and movement, and are not generally released from each other by the action of gravity.

In a first family of embodiments, the invention comprehends a combination comprising an elongate first nosing and an elongate second nosing. The first nosing comprises an elongate first inner flange having a first outer end and a second inner end, an elongate first outer flange having a third outer end, and a fourth inner end. The first outer flange is spaced from the first inner flange. An elongate first outer-facing web connects to the first inner flange and to the first outer flange. An elongate first inner-facing web connects to the first inner flange and to the first outer flange. A first elongate receptacle has a first opening communicating with at least one of the first outer flange, the first outer-facing web, and the first inner-facing web. A first remote wall of the first elongate receptacle defines, at least in part, a first elongate insert. The second nosing comprises an elongate second inner flange having a fifth outer end, and a sixth inner end, and an elongate second outer flange having a seventh outer end, and an eighth inner end, the second outer flange being spaced from the second inner flange. An elongate second outer-facing web connects to the second inner flange and to the second outer flange. An elongate second inner-facing web connects to the second inner flange and to the second outer flange. And a second elongate receptacle has a second opening communicating with at least one of the second inner flange, the second outer-facing web, and the second inner-facing web. A second remote wall of the second elongate receptacle defines, at least in part, a second elongate insert. One of the first and second elongate receptacles extends from the respective first or second opening, into the respective nosing and toward the respective inner-facing web. The other one of the first and second elongate receptacles extends from the other respective first or second opening into the respective other one of the first or second nosings and toward the respective first or second outer-facing web. The first and second nosings are adapted to be assembled to each other with the first insert received in the second receptacle and the second insert received in the first receptacle.

In some embodiments, the first and second nosings are assembled to each other with a frictionally-restrained engagement and the assembled combination can be re-oriented, with limited assembly support to the assembly, without disengagement of the first and second nosings by force of gravity.

In some embodiments, at least one of the first and second nosings defines a stop, including a stop location, with respect to the other of the first and second nosings, the first and second nosings, when assembled to each other, to the stop location provided by the stop, present the first and second outer-facing webs as a generally continuous surface.

In some embodiments, the invention further comprises lock structure communicating with the first inner-facing web, and an opening in the lock structure, such opening extending, from outside the nosing, between the first and second locks, to an inner space in the nosing between the inner flange and the outer flange.

In some embodiments, the invention further comprises first and second mounting fingers extending from the second inner-facing web and being generally parallel to the second outer flange, and a front drip flange extending from the second outer flange, generally in line with the second inner-facing web and away from the second inner flange.

In some embodiments, the invention further comprises first and second mounting fingers extending from the first inner-facing web and generally parallel to the first inner flange, and a front facia flange extending from the first inner flange, and generally in line with the first inner-facing web and away from the first outer flange.

In some embodiments, the first and second nosings are extruded aluminum profiles, and the first and second inner and outer flanges, the first and second inner-facing webs, and the first and second outer-facing webs have general web thicknesses of about 0.05 inch to about 0.09 inch.

In some embodiments, the invention comprehends a door frame assembly comprising a door frame including a plurality of door jambs, and a window frame including a plurality of window jambs, first and second nosings of the invention being mounted collectively to the door frame and to the window frame, the first and second nosings being assembled to each other at the first and second receptacles.

In some embodiments, the door frame further comprises first and second locks at the first inner-facing web, and an opening between the first and second locks, such opening extending, from outside the first nosing, between the first and second locks, to an inner space in the first nosing between the inner flange and the outer flange, one of the door jambs comprising a header jamb, the header jamb comprising a jamb substrate, and an extruded aluminum jamb, the jamb cover comprising a main side panel covering a first surface of the jamb substrate, and a cover panel covering a second adjacent surface of the jamb substrate, the cover panel comprising locking structure extending through the opening in the first inner-facing web and engaging the first and second locks and thus mounting the first nosing to the jamb cover, and thus to the header jamb.

In a second family of embodiments, the invention comprehends a door frame assembly comprising a door frame, and a window frame mounted to the door frame. The door frame comprises a left side door jamb, a right side door jamb, and a header door jamb. The left and right side door jambs are mounted to the header door jamb. At least one of the left side door jamb, the right side door jamb, and the header door jamb have an outer surface. A first nosing is included at the respective at least one door jamb at the outer surface. The first nosing comprises an elongate first inner flange having a first outer end and a second inner end. An elongate first outer flange has a third outer end and a fourth inner end. The first outer flange is spaced from the first inner flange. An elongate first outer-facing web connects to the first inner flange and to the first outer flange. An elongate first inner-facing web connects to the first inner flange and to the first outer flange. A first elongate receptacle has a first opening communicating with at least one of the first outer flange, the first outer-facing web, and the first inner-facing web. A first elongate remote wall of the first elongate receptacle defines, at least in part, a first elongate insert. The window frame comprises a plurality of window jambs, connected to each other. At least one second nosing is included at least one of the plurality of window jambs. The second nosing comprises an elongate second inner flange having a fifth outer end, and a sixth inner end. An elongate second outer flange has a seventh outer end, and an eighth inner end. The second outer flange is spaced from the second inner flange. An elongate second outer-facing web connects to the second inner flange and to the second outer flange. An elongate second inner-facing web connects to the second inner flange and to the second outer flange. A second elongate receptacle has a second opening communicating with at least one of the second inner flange, the second outer-facing web, and the second inner-facing web. A second remote wall of the second elongate receptacle defines, at least in part, a second elongate insert. One of the first and second elongate receptacles extends from the respective first or second opening, into the respective nosing and toward the respective inner-facing web. The other one of the first and second elongate receptacles extends from the other respective first or second opening into the respective other one of the first or second nosings and toward the respective first or second outer-facing web. The first and second nosings are mounted to each other, thereby at least temporarily mounting the window frame to the door frame.

In some embodiments, the first insert is in the second receptacle and the second insert is in the first receptacle.

In some embodiments, the first outer flange of the first nosing is in face-to-face relationship with the second inner flange of the second nosing at the first and second inner-facing webs.

In some embodiments, the invention further comprises first and second mounting fingers extending from the second inner-facing web, the first and second mounting fingers being generally parallel to the second inner flange and extending away from the second outer-facing web, a front drip flange extending from the second outer flange, generally in line with the second inner-facing web and away from the second inner flange.

In some embodiments, the door frame assembly further comprises first and second locks at the first inner-facing web, and an opening between the first and second locks, the opening extending, from outside the first nosing, between the first and second locks, to an inner space in the first nosing between the inner flange and the outer flange, the respective door jamb to which the first nosing is mounted comprising a jamb substrate, and an extruded aluminum jamb cover covering first and second surfaces of the respective jamb substrate, the jamb cover comprising a main side panel and a cover panel, the cover panel comprising third and fourth locks extending through the opening in the first inner-facing web and engaging the first and second locks and thus mounting the first nosing to the respective jamb cover, and to the respective jamb.

In a third family of embodiments, a window frame assembly comprises a first window frame and a second window frame. The first window frame comprises a first plurality of window jambs, mounted to each other. At least one of the first plurality of window jambs on the first window frame has a first outer surface. At least one first nosing is mounted to the respective at least one first window jamb at the outer surface of the respective at least one first window jamb. The first nosing comprises an elongate first inner flange having a first outer end and a second inner end. An elongate first outer flange has a third outer end, and a fourth inner end. The first outer flange is spaced from the first inner flange. An elongate first outer-facing web connects to the first inner flange and to the first outer flange. An elongate first inner-facing web connects to the first inner flange and to the first outer flange. A first elongate receptacle has a first opening communicating with at least one of the first outer flange, the first outer-facing web, and the first inner-facing web. A first remote wall of the first elongate receptacle defines, at least in part, a first elongate insert. The second window frame comprises a second plurality of window jambs, mounted to each other. At least one of the second plurality of window jambs on the second window frame has a second outer surface. At least one second nosing is mounted to the respective at least one second window jamb at the outer surface of the respective at least one second window jamb. The second nosing comprises an elongate second inner flange having a fifth outer end, and a sixth inner end. An elongate second outer flange has a seventh outer end, and an eighth inner end. The second outer flange is spaced from the second inner flange. An elongate second outer-facing web connects to the second inner flange and to the second outer flange. An elongate second inner-facing web connects to the second inner flange and to the second outer flange. A second elongate receptacle has a second opening communicating with at least one of the second inner flange, the second outer-facing web, and the inner-facing web. A second remote wall of the second elongate receptacle defines, at least in part, a second elongate insert. One of the first and second elongate receptacles extends from the respective first or second opening, into the respective nosing and toward the respective inner-facing web. The other one of first and second elongate receptacles extends from the other respective first or second opening into the respective other one of the first or second nosings and toward the respective first or second outer-facing web. The first and second nosings are mounted to each other, thereby at least temporarily mounting the first and second window frames to each other.

In some embodiments, the window frame assembly further comprises first and second mounting fingers extending from the second inner-facing web and generally parallel to the second outer flange and extending away from the second outer-facing web, and third and fourth mounting fingers extending from the first inner-facing web and generally parallel to the first inner flange and extending away from the first outer-facing web.

In a fourth family of embodiments, the invention comprehends a method of assembling first and second frames, which represent door frames and/or window frames, to each other. The method comprises defining a first frame comprising a first plurality of jambs, connected to each other. At least one of the first plurality of jambs on the first frame has a first outer surface, a first nosing being mounted to the respective at least one of the first plurality of jambs at the outer surfaces of the respective jambs. The first nosing comprises an elongate first inner flange having a first outer end and a second inner end. An elongate first outer flange has a third outer end, and a fourth inner end. The first outer flange is spaced from the first inner flange. An elongate first outer-facing web connects to the first inner flange and to the first outer flange. An elongate first inner-facing web connects to the first inner flange and to the first outer flange. A first elongate receptacle has a first opening communicating with at least one of the first outer flange, the first outer-facing web, and the first inner-facing web. A first elongate remote wall of the first elongate receptacle defines, at least in part, a first elongate insert. The invention further comprises defining a second frame comprising a second plurality of jambs, mounted to each other. At least one of the second plurality of jambs on the second frame has a second outer surface. A second nosing is mounted to the respective at least one of the second plurality of jambs at the outer surfaces of the respective jambs. The second nosing comprises an elongate second inner flange having a fifth outer end, and a sixth inner end. An elongate second outer flange has a seventh outer end, and an eighth inner end. The second outer flange is spaced from the second inner flange. An elongate second outer-facing web connects to the second inner flange and to the second outer flange. An elongate second inner-facing web connects to the sixth end of the second inner flange and to the eighth end of the second outer flange. A second elongate receptacle has a second opening communicating with at least one of the second inner flange, the second outer-facing web, and the second inner-facing web. A second elongate remote wall of the second elongate receptacle defines, at least in part, a second elongate insert. One of the first and second elongate receptacles extends from the respective first or second opening, into the respective nosing and toward the respective inner-facing web. The other one of the first and second elongate receptacles extends from the other respective first or second opening into the respective other one of the first or second nosings and toward the respective first or second outer-facing web. The method further comprises bringing the first and second frames together in such alignment that the first remote wall is proximate and generally aligned with the opening in the second receptacle, and the second remote wall is proximate and generally aligned with the opening in the first receptacle, with the first outer flange generally in surface-to-surface alignment with the second inner flange, and moving the first frame relative to the second frame such that the first elongate insert enters the second elongate receptacle and the second elongate insert enters the first elongate receptacle and wherein the first and second remote walls are generally facing each other and are facilitating at least temporarily assembling the first and second nosings, and correspondingly the first and second frames, to each other.

In some embodiments, the first and second frames have outer portions at the first and second nosings, and inner surfaces remote from the outer portion, further comprising, after temporarily assembling the first and second frames to each other at the nosings, fastening the first and second frames to each other at the inner surfaces.

The present invention will be further appreciated and understood when considered in combination with the following description and the accompanying drawings. It should be understood, however, that the following description is given by way of illustration and not of limitation. Certain changes and modifications can be made within the scope of the invention without departing from the spirit of the invention, and the invention includes all such changes and modifications.

Figure 1:
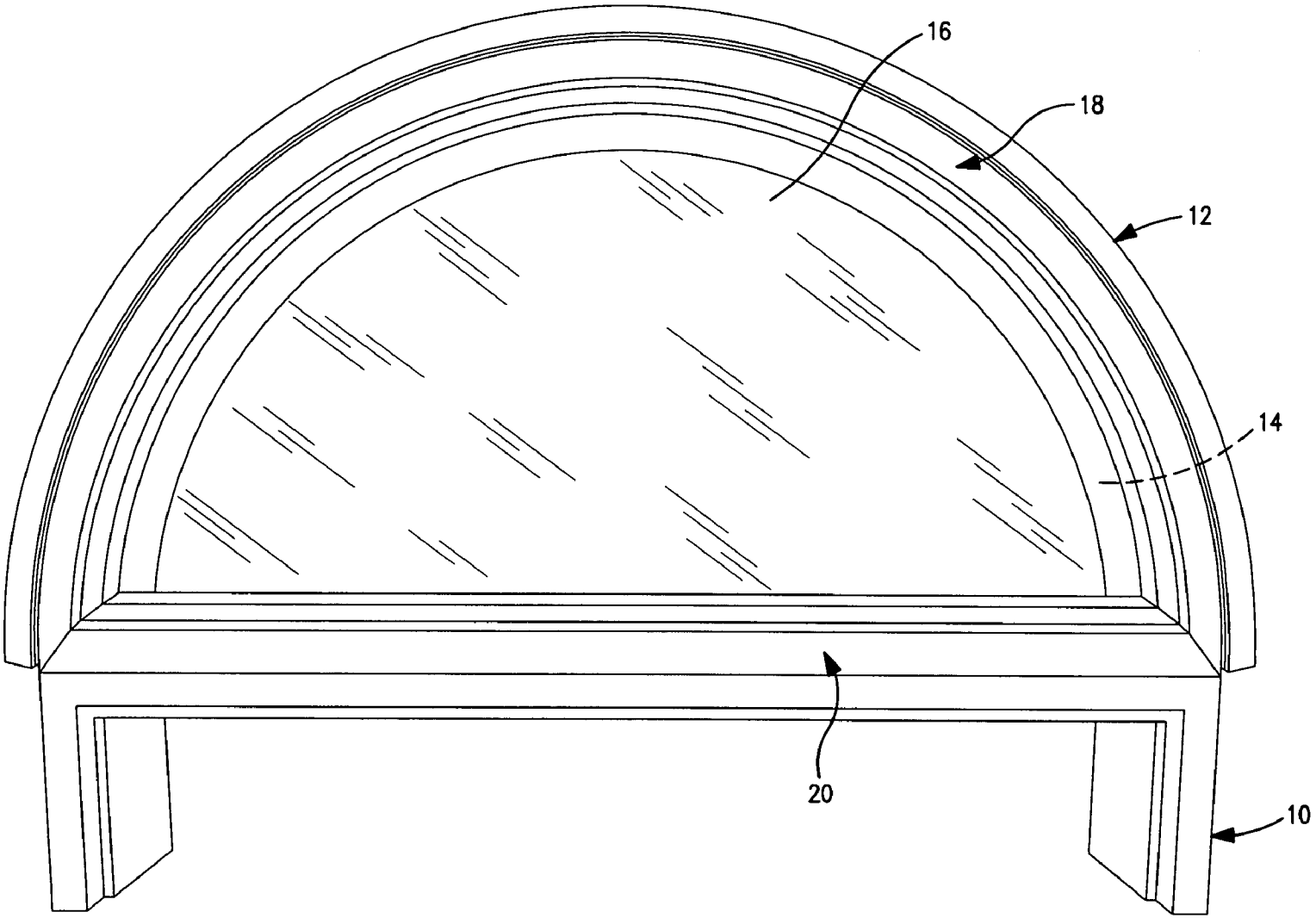
FIG. 1 illustrates a front elevation view of an assembly comprising a transom window mounted over a door frame, with the door frame being shown in part.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

Figure 2:
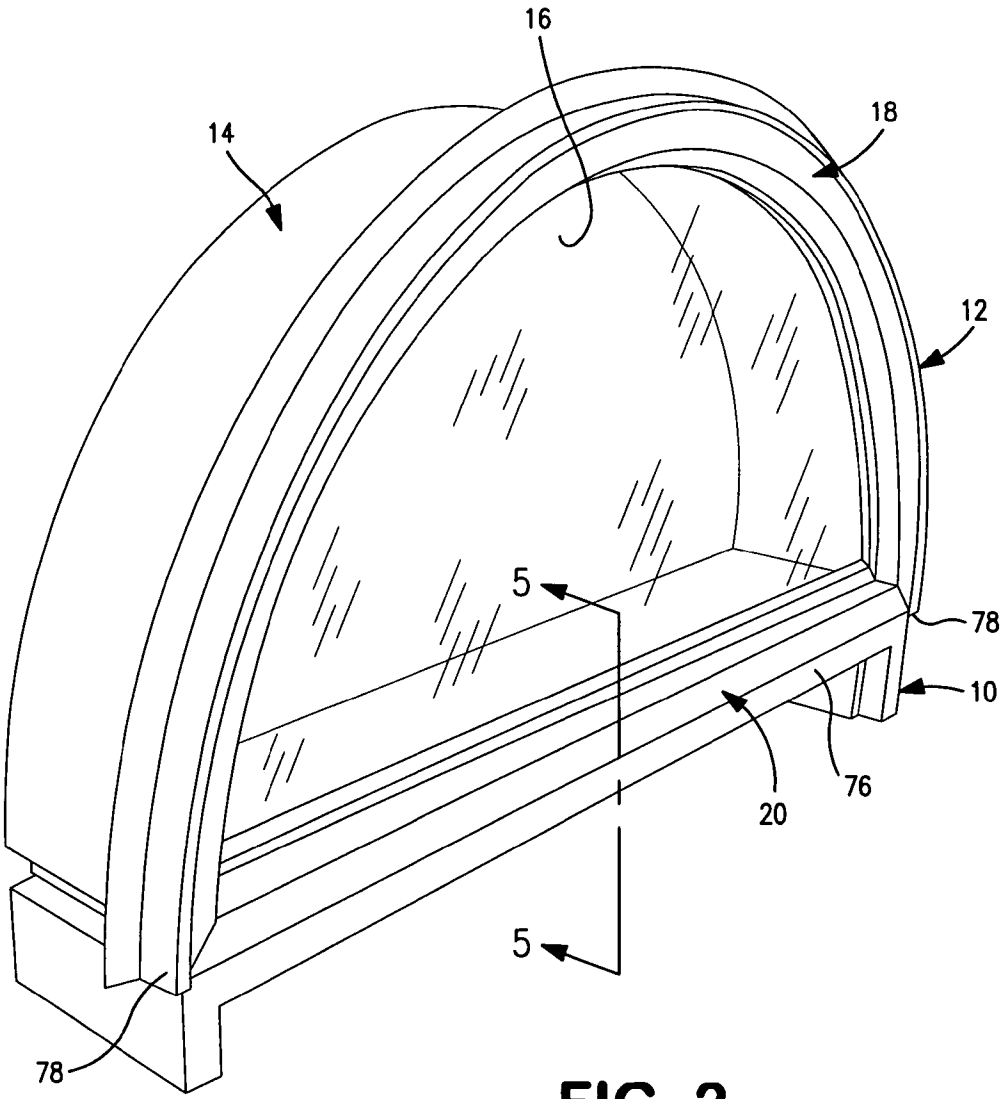
FIG. 2 shows a pictorial view of the assembly of FIG. 1.

FIG. 1 illustrates a front view of a cladded arcuate transom window of the invention mounted on the top of a cladded door frame, with only the top portion of the door frame being shown. FIG. 2 shows the same arcuate transom window mounted at the top of the same door frame, in orthogonal view. As seen in FIGS. 1 and 2, the door frame in general is represented by the number 10. The transom window 12 of the invention is mounted on the door frame by structure described hereinafter.

Window 12 includes a window frame 14 illustrated as being made of wood, a glazing unit 16 mounted in the window frame, an elongate arcuate extruded aluminum nosing assembly 18, and an elongate straight extruded aluminum nosing 20. Arcuate nosing assembly 18 is mounted to the upper, arcuate portion of the window frame. Straight nosing 20 is mounted to the lower, straight portion of the window frame.

Figure 3:
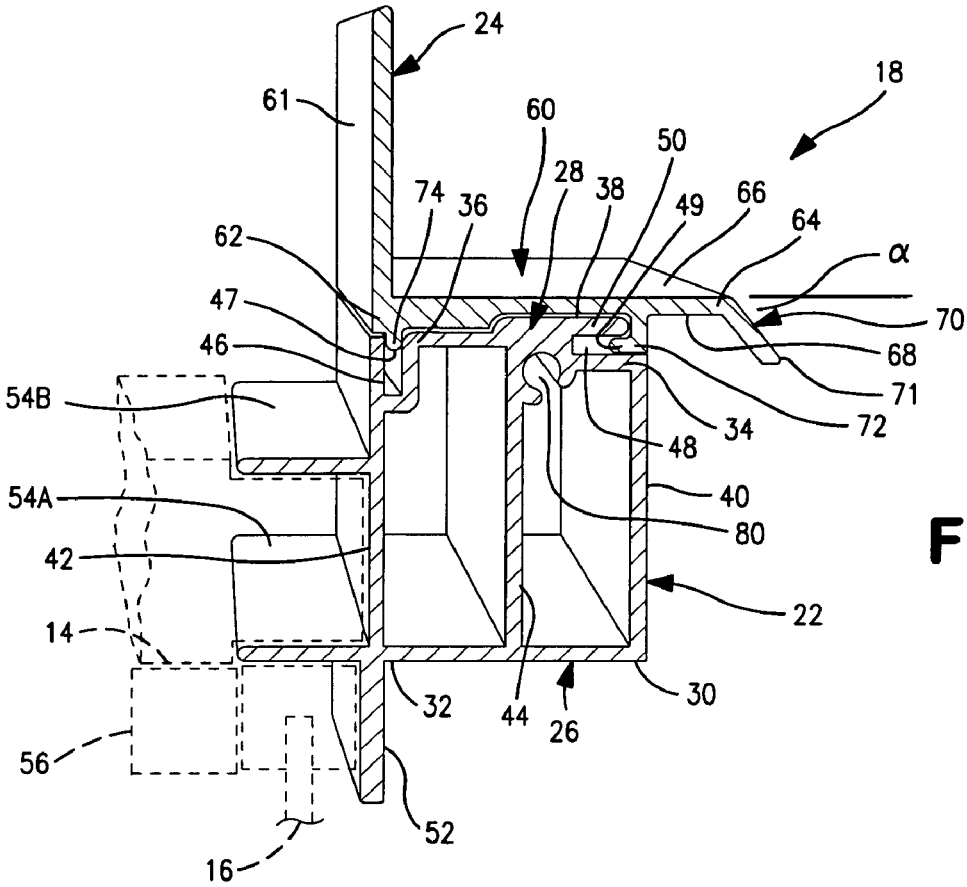
FIG. 3 shows a cross-section of a short length of a straight nosing assembly of the invention, illustrating locations of the window framing, the glass stop, and the glazing assembly.
Figure 4:
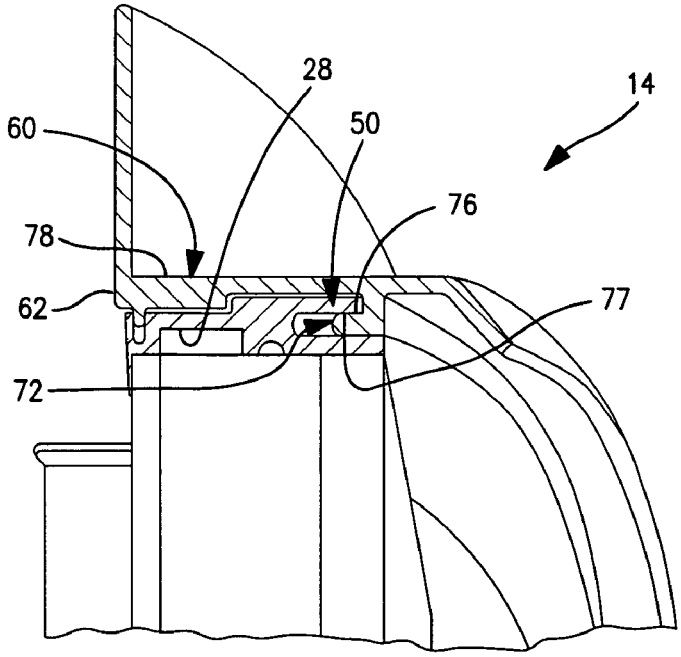
FIG. 4 shows an upwardly-directed end view of the assembly of FIGS. 1 and 2, illustrating the cooperative crimping affect of the hook in the hook receptacle when the nosing assembly is bent, thus securing the drip cap on the nosing by means of the bending process.

Referring now to FIGS. 3 and 4, FIG. 3 shows a short length of a combination of a nosing 22 and a drip cap 24, in their as-extruded, straight configurations, with the drip cap and nosing temporarily assembled to each other. FIG. 4 shows the elongate combination mounted to the window frame after the nosing and drip cap have been bent into the desired arcuate configuration, with corresponding securement of the nosing and drip cap to each other during the bending process.

Turning back to FIG. 3, nosing 22 has an inner flange 26, and an outer flange 28 spaced from the inner flange. Inner flange 26 has a first outer end 30 and a second inner end 32. Outer flange 28 has a third outer end 34, a fourth inner end 36, and an outer surface 38.

An elongate outer-facing web 40 connects to the inner and outer flanges at outer ends 30 and 34. Elongate inner-facing web 42 connects to the inner and outer flanges at inner ends 32 and 36. Elongate intermediate web 44 connects to intermediate portions of the inner and outer flanges.

An elongate stud-receiving receptacle 46, adjacent inner-facing web 42, has an opening 47 extending downwardly and toward the inner flange, from outer surface 38 of outer flange 28. An elongate hook-receiving receptacle 48 has an opening 49 adjacent outer end 34 of outer flange 28. The hook-receiving receptacle extends from the opening 49 toward inner-facing web 42. The hook-receiving receptacle includes a remote upper wall 50 defined between the main body of the receptacle and the upper surface 38 of outer flange 28. Remote upper wall 50 of the hook-receiving receptacle is generally spaced from the remaining portions of nosing 22.

Elongate front facia flange 52 extends downwardly from the inner flange 26, generally as an extended element of inner-facing web 42. In the illustrated embodiment, the front facia flange has a substantially thicker cross-section than either the adjacent inner flange 26 or the adjacent inner-facing web 42.

A first elongate mounting finger 54A extends generally as an extension of the inner flange from the joinder of the inner flange and the inner-facing web. A second elongate mounting finger 54B is spaced from the first mounting finger, generally parallel to the first mounting finger, and extends from the inner-facing web away from the outer-facing web. FIG. 3 shows, in dashed outline, a portion of the window frame 14 which fits between mounting fingers 54A and 54B, including the recesses cut into the frame member such that the outer surface of the frame member represents a generally continuous surface with the corresponding outer surface of the second mounting finger.

FIG. 3 also illustrates in dashed outline the glazing stop 56 which abuts glazing assembly 16, also shown in dashed outline. Glazing assembly 16 abuts front facia flange 52. Flange 52, glazing assembly 16, the illustrated frame element 14, and glazing stop 56 thus illustrate the relative positioning of the main body of the window frame, the upper arcuate nosing assembly, and the window glazing assembly.

Returning to the nosing assembly, elongate drip cap 24 has a platform 60 and a drip flashing flange 61. Platform 60 has an inner end 62, an outer end 64, an upper surface 66, and a lower surface 68. An elongate drip flange 70 extends downwardly from outer end 64 of the platform at an angle "α" of about 30 degrees, more or less in the embodiment illustrated. Angle "α" is required to, and the magnitude of angle "α" is selected to, direct water away from the window frame to a drip edge 71. Thus, the magnitude of angle "α" can vary depending on the particular implementation. An elongate hook 72 extends down from a locus on the platform lower surface which locus is generally toward outer end 64; and the hook extends from there toward inner end 62 of the platform.

An elongate stud 74 extends downwardly from the lower surface 68 of the platform, adjacent inner end 62 of the platform.

The nosing assembly illustrated in FIG. 3 is designed to loosely fit together such that, at initial assembly of the straight extruded elements, the drip cap and nosing can readily slide longitudinally with respect to each other with limited, if any, noticeable friction.

The straight drip cap and the straight nosing can be initially joined together by longitudinally sliding the drip cap and nosing with respect to each other, with the hook engaged in the hook receptacle. With the hook so engaged, the stud is automatically aligned over the stud receptacle and is readily engaged in the stud receptacle.

As a second method of joining the nosing and the drip cap, the nosing and drip cap can be brought together with the lower surface of the drip cap overlying the upper surface of the outer flange, and with the leading edge of the hook at opening 49 of the hook receptacle. With the hook so positioned, the stud is proximate, but displaced from, stud receptacle 46. The drip cap is then slid toward fourth inner end 36 of outer flange 28, to a stop location where the structure of the platform or nosing stops the engaging of the hook into the hook receptacle and the stud is in alignment over the stud receptacle. With the hook so-engaged and fully seated in the hook receptacle, the stud is readily seated in the stud receptacle. Full engagement of the hook and the stud, thus brings the drip cap and the nosing into registered alignment with respect to each other relative to the inner and outer webs, e.g. such that the inner end of the drip cap platform is aligned with the inner end of the outer flange of the nosing.

The nosing and drip cap are easily disassembled from each other at this stage by simply raising the inner end of the drip cap, thus disengaging the stud from the stud receptacle and then sliding the drip cap relatively toward the outer-facing web. As a second disassembly technique, the drip cap can simply be slid longitudinally with respect to the nosing.

With the drip cap so-joined to the nosing, as a temporary assembly that can be readily separated, the temporary assembly can be converted to a permanently-mounted assembly having an arcuate shape. To make such conversion, the temporary assembly is mounted in a bending jig or other suitable machine. The nosing/drip cap assembly combination is then bent into a desired arcuate configuration, typically in a cold-forming process, bending both the drip cap and the nosing together as a single unit. In the illustrated embodiments, the assembly is bent with the inner flange of the nosing disposed toward the interior of the bend and the drip cap platform disposed toward the outside of the bend.

As the bending force is applied collectively to both nosing 22 and drip cap 24, both the nosing and the drip cap, bending together, take on bent configurations generally similar to each other. As the bending force is released, and the normal limited rebound of the cold-formed elements occurs, the now-arcuate upper surface 76 of hook 72 is left in a forceful abutting-type surface-to-surface engagement with the arcuate lower surface 77 of upper wall 50, as illustrated in FIG. 4. The surface-to-surface engagement locks the nosing and drip cap to each other, creating the nosing assembly, and provides a stabilizing frictional relationship between the hook and the remote upper wall of the hook receptacle, holding the drip cap and the nosing firmly engaged with, and locked to, each other such that no additional measures need be taken to retain the now-arcuate nosing and the now-arcuate drip cap in the assembled relationship with each other.

In addition to the locking of the nosing and the drip cap to each other, the resulting abutting engagement between the hook and the hook receptacle, and the convoluted path around hook 72, around wall 50, and along the interface between outer flange 28 and platform 60, to inner end 62, serves as a barrier to air-borne water penetrating to inner end 62 of the nosing assembly where such water can potentially reach water-susceptible wood frame 14. Applicant contemplates that such barrier is effective to prevent weather-generated water penetration except, perhaps, in dangerously-violent weather conditions.

In the arcuate embodiments built to date, of which FIGS. 1, 2, and 4 are representative, it appears that the rebounded drip cap tends to stabilize after the bending operation, with the ends 78 of the drip cap drawn away from the nosing at inner end 62 of the platform, by up to e.g. about 0.15 inch. Such spacing of the inner ends 78 of the drip cap from the nosing can be readily remedied by driving a single screw (not shown) through platform 60 and into outer flange 28 of the nosing in each end region of the arcuate nosing assembly, e.g. between inner-facing web 42 and intermediate web 44. Tightening such screws draws the inner end 62 of the platform into intimate relation with outer flange 28, thus essentially eliminating the open space between the drip cap and the nosing at inner ends 62, namely holding the elements in the configuration shown in FIG. 4. Thus, the invention eliminates all except two of the assembly screws which are used in conventional nosing/drip cap assemblies.

And, in order to better insure that the two screws which are used are not entry points for water getting into the window frame, once the screw holes are drilled after the drip cap and nosing are bent, caulk or other flexible sealing compound is forced/injected between the drip cap and the nosing, from the ends of the drip cap and nosing, to and past the screw holes. When a screw is installed, and the drip cap and nosing are drawn together, the space between the drip cap and the nosing, at the ends of the nosing and drip cap, is closed. As the distance between the nosing and drip cap is closed, the caulk is forced to spread in the narrowing space, filling voids between the screw and the side walls of the holes, and occupying the space between the nosing and the drip cap. This application of caulk, including the method of spreading the caulk about the holes which present potential water entry points, essentially eliminates risk of water entering the window frame through the screw holes.

The observed abutting surface-to-surface locking-type engagement of the hook and the upper wall of the hook receptacle, with each other, may be at least in part caused by re-forming of the configuration of the hook 72 relative to the hook receptacle 48 as the nosing and the drip cap take on the arcuate configuration, as well as by the collective rebound from the forming/bending operation. Whatever the mechanism, the bending of the nosing and the drip cap, collectively as the nosing assembly, brings the nosing and the drip cap into an essentially inseparable locked engagement at hook 72 and upper wall 50 as illustrated in FIG. 4, with the hook and hook receptacle providing a substantial barrier to water penetrating into the frame through the resulting nosing assembly.

Both hook receptacle 48 and stud receptacle 46 extend to depths substantially greater than the depths reached by the hook or the stud. The space between the end of the stud and the end of the stud receptacle is greater than the space occupied by the stud in the receptacle. Similarly, the space between the end of the hook and the end of the hook receptacle is greater than the space occupied by the hook in the hook receptacle. Such greater depths allow for flow of material during the bending of the initially-joined nosing/drip cap assembly.

While hook receiving opening 48 is illustrated on the outer flange, opening 48 can as well be located on the outer-facing web or the inner-facing web. And while the hook receptacle is shown extending toward the inner-facing web, it could as well extend toward the outer-facing web.

What is important for the hook receptacle is that the receptacle extend in such direction that an upper wall of the receptacle, or other structure which is capable of cooperating with a hook to re-form and/or engage the combination, is defined as part of the hook receptacle. In the illustrated embodiment, the combination is re-formed such that the hook and the upper wall of the receptacle are brought into the firm abutting-type locking engagement whereby the drip cap and the nosing are securely bound to each other.

The opening for the hook receptacle can be located on the outer flange as shown, or on the inner-facing web, or on the outer-facing web. For example, opening 49 can be located anywhere along the height of the outer-facing web, e.g. between inner and outer flanges 26 and 28, whereby hook 72 extends down the face of the outer-facing web 40 to the opening. A similar arrangement can, in the alternative, be defined for the inner-facing web 42. When the assembly is bent and released, both the hook, as part of the drip cap, and the receptacle as part of the nosing, are re-formed, and the resulting abutting-type locking engagement is created.

The hook receptacle is illustrated remote from drip flashing flange 61 and the stud receptacle is illustrated proximate the drip flashing flange. The hook receptacle and the stud receptacle can be relocated to generally reversed relative positions, and are typically spaced from each other. The hook and stud are correspondingly relocated also.

In the illustrated embodiments, the nosing and drip cap are elongate aluminum extrusion profiles. As such, each element defined in such profiles typically extends, as extruded, for the full length of the respective profile. Thus, the extrusions generally function as cladding, covering/cladding surfaces of the wood substrate elements which generally provide the structural substance of the window frame and which surfaces would otherwise be exposed to the ambient environment.

While the description herein addresses primarily wood substrates for window and door frames, the substrates can be any desired material including, without limitation, solid plastic substrates, extruded profile plastic substrates, extruded aluminum profiles, pultruded fiberglass-reinforced profiles, or combinations of any of the above, with or without wood elements.

In the illustrated embodiment of FIGS. 3-4, the extruded aluminum profile elements in the nosing are generally 0.05 inch thick. Thus, inner and outer flanges 26 and 28, webs 42, 44, and 46, drip flashing flange 61, and mounting fingers 54A and 54B are all generally about 0.04 inch to about 0.06 inch thick, allowing for the thicker structure on outer flange 28 which supports upper wall 50 of the hook receptacle, and the illustrated screw boss. Facia flange 52 is about 0.07 inch to about 0.10 inch thick, optionally about 0.08 inch to about 0.10 inch thick, as it has surprisingly been found that a thicker facia flange 52 can better receive the material flow during the bending process, without buckling. Drip cap platform 60 is about 0.09 inch to about 0.12 inch thick proximate inner end 62 and about 0.04 inch to about 0.06 inch thick adjacent outer end 34 and screw boss 80.

EXAMPLE 1

Making an Arcuate Nosing Assembly

Referring to FIG. 3, a straight, loosely-assembled nosing assembly was made having approximately the following material thicknesses. Inner and outer flanges 26 and 28, webs 42, 44, and 46, drip flashing flange 61, and mounting fingers 54A and 54B were all generally about 0.05 inch thick, allowing for the thicker structure on outer flange 28 which supports hook finger 50 and the illustrated screw boss. Facia flange 52 was about 0.09 inch thick. Drip cap platform 60 was about 0.09 inch thick proximate inner end 62 and about 0.045 inch thick adjacent outer end 34 and screw boss 80.

The general size of the nosing profile as seen in FIG. 3 was about 1.25 inches high and about 1 inch wide. Facia flange length was about 0.5 inch. Platform length was, left-to-right, about 1.25 inches. Flashing flange height was about 1.1 inches. Mounting fingers 54A, 54B were about 0.5 inch wide. In the loosely-assembled assembly, with stud 74 in stud receptacle 46, and hook 72 in hook receptacle 48 as illustrated in FIG. 3, the drip cap was readily longitudinally slidable relative to the nosing. For disassembly, the drip cap was readily slidable toward the outer-facing web after raising stud 74 out of stud receptacle 46, thus to release the drip cap from the nosing.

The thus loosely-assembled straight assembly was then placed in a bending jig and bent about an approximately 18-inch radius, measured from the inner flange, into a half-circle, and released from the bending operation. Once released, the assembly retained its general half-circle configuration and the resulting bent assembly exhibited a strong securement of the drip cap and nosing to each other along the bent length, such that the drip cap and the nosing were essentially inseparable from each other along the bent length. A strong abutting-type locking engagement was noted between hook 72 and upper wall 50. Thus, upon completion of the bending process, the drip cap and the nosing were in a locked relationship with each other.

Given the 18-inch radius bend in the subject nosing assembly, the inventor contemplates that even shorter radius bends such as 15 inches radius, or 12 inches radius, or 7.5 inches radius, may be achieved with little if any modification to the disclosed profiles and such shorter-radius profiles are thus considered to be part of the invention. The inventor contemplates that, in light of the disclosure herein, substantially any radius equal to half of the width of conventional commercially-available windows and doors, down to e.g. about 6 inches radius, can be accommodated by making obvious modifications to the nosing and drip cap profiles in order to achieve some of the smaller such radii whereby all such radii are considered to be enabled by the disclosure herein.

The above portion of the detailed description generally refers to the upper arcuate portion of transom window frame 14. Turning now to the interface between transom window 12 and door frame 10, reference is made to FIGS. 1 and 2, and especially to FIG. 5, where nosing 20 joins the lower portion of the transom window to the upper portion of the underlying clad door frame.

Figure 5:
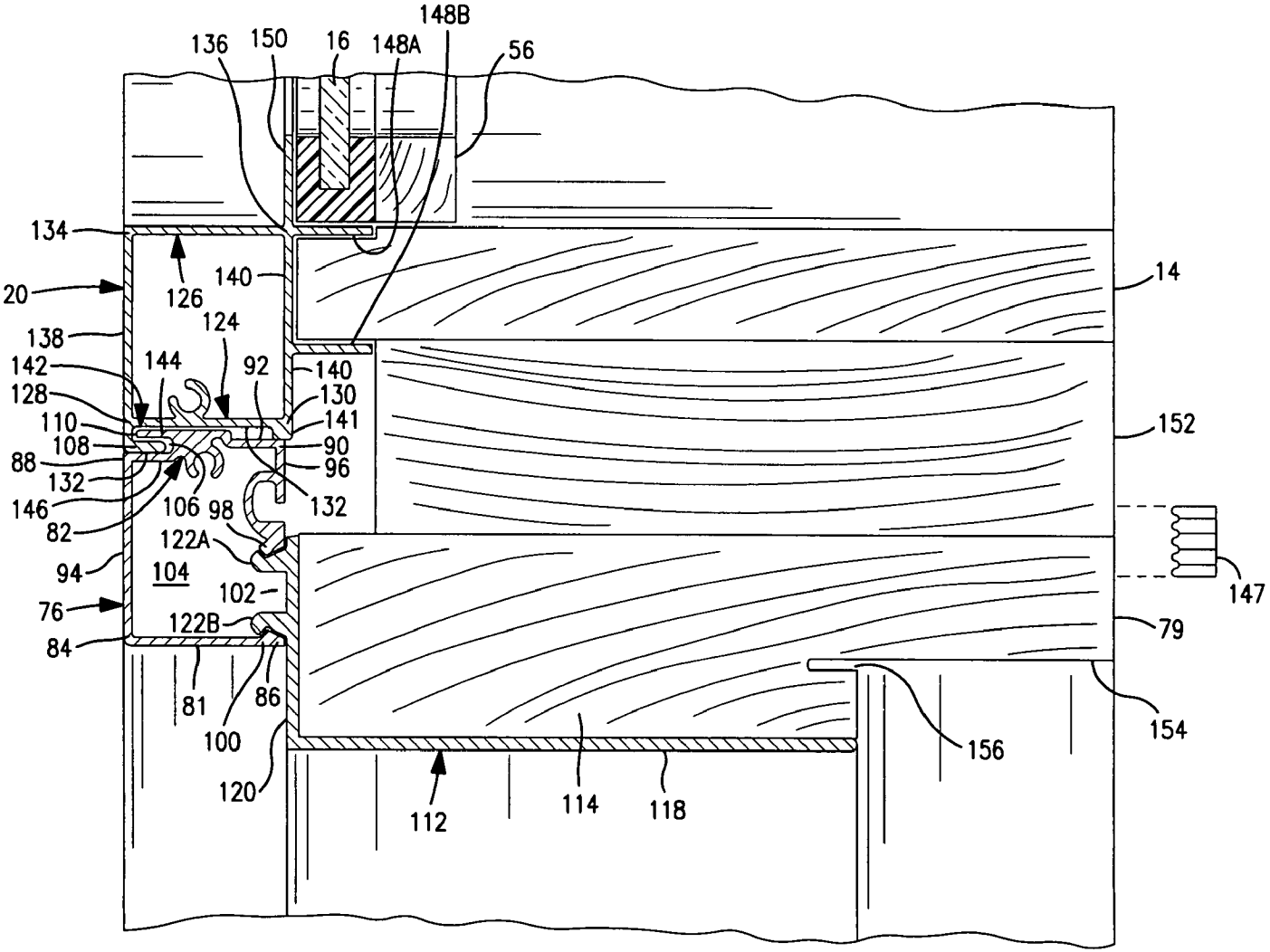
FIG. 5 shows a cross-section taken at 5-5 of FIG. 2 illustrating the horizontal joint between the underlying door frame and the overlying arcuate transom window.

Turning now to FIG. 5, nosing 76 on header jamb 79 of the clad door frame interfaces with nosing 20 on the window frame.

As seen in FIG. 5, nosing 76 has an inner flange 81, and an outer flange 82 spaced from the inner flange. Inner flange 81 has a first outer end 84 and a second inner end 86. Outer flange 82 has a third outer end 88 and a fourth inner end 90, and an outer surface 92.

An elongate outer-facing web 94 connects to the inner and outer flanges at outer ends 84 and 88. Elongate inner-facing web 96 connects to the outer flange at inner end 90 and extends toward inner end 86.

A first lock 98 on the inner-facing web and a second lock 100 at the inner end 86, of the inner flange define an opening 102 which extends from outside the nosing, between the first and second locks, and into the interior space 104 inside the nosing.

An elongate receptacle 106 has an opening 108 where third outer end 88 of outer flange 82 and the upper end of outer-facing web 94 come together. Thus, opening 108 can be considered either as part of outer flange 82 or as part of web 94. Receptacle 106 extends from opening 108 toward inner-facing web 96. Receptacle 106 includes a remote upper wall 110 defined between the main body of the receptacle and the outer surface 92 of outer flange 82. Remote upper wall 110 is generally spaced from the remaining portions of nosing 76.

Nosing 76 is mounted to jamb cover 112. Jamb cover 112 covers the surfaces of an e.g. wood jamb substrate 114 of the header jamb 79 of the door frame, thus, generally functioning as cladding and thereby covering surfaces of the wood substrate elements which generally provide the structural substance of the door frame and which surfaces are otherwise exposed to ambient environmental conditions. Jamb cover 112 has a main side panel 118 which covers that side of the e.g. wood substrate which faces into the doorway opening. Outer panel 120 of the jamb cover is joined to main side panel 118 at a common corner, and covers the side of the substrate which faces away from the building. Lock structure extends from the outer panel in the physical expression of two lock studs 122A, 122B. Lock studs 122A, 122B interface with first and second locks 98 and 100 on the nosing 76.

Jamb cover 112 can be mounted to the substrate by e.g. screws or other fasteners, not shown, at screw apertures, not shown, between lock studs 122A and 122B, such apertures being spaced along the length of the jamb cover.

Given the relative flexibility in the respective locks on the extruded aluminum nosing 76 and jamb cover 112, nosing 76 can be secured/mounted to the jamb cover, and thus to the illustrated header jamb, by snap-locking the first and second locks 98 and 100 on nosing 76 to studs 122A and 122B on the jamb cover.

Nosing 20 has an inner flange 124, and an outer flange 126 spaced from the inner flange. Inner flange 124 has a fifth outer end 128, a sixth inner end 130, and an inner surface 132. Outer flange 126 has a seventh outer end 134 and an eighth inner end 136.

An elongate outer-facing web 138 connects to the inner and outer flanges at outer ends 128 and 134. Elongate inner-facing web 140 connects to the inner and outer flanges at inner ends 130 and 136. An elongate spacing stud 141 extends down from inner surface 132 of inner flange 124. Spacing stud 141 thus spaces the inner flange of nosing 20 from the outer flange of nosing 76 by a distance which maintains the inner flange of nosing 20 in a generally parallel relationship with the outer flange of nosing 76 for the full depth, between the inner-facing webs and the outer-facing webs, of nosings 76 and 20, whereby outer-facing webs 94 and 138 define a generally common and flat surface.

An elongate receptacle 142 proximate fifth outer end 128 of nosing 20 has an opening 144 spaced, from outer end 128, toward the sixth inner end 130 of inner flange 124. Receptacle 142 extends from opening 144 toward outer-facing web 138. Receptacle 142 includes a remote lower wall 146 defined between the main body of the receptacle and inner surface 132 of inner flange 124. Remote lower wall 146 is generally spaced from the remaining portions of nosing 20.

A first elongate mounting finger 148A extends generally as an extension of outer flange 126 from the joinder of outer flange 126 and inner-facing web 140. A second elongate mounting finger 148B is spaced from the first mounting finger and extends from the inner-facing web away from the outer-facing web, generally parallel to mounting finger 148A. FIG. 5 shows a portion of the window frame 14 which fits between mounting fingers 148A and 148B, including a recess cut into the upper surface of the frame member such that the upper surface of the frame member represents a generally continuous surface with the corresponding outer surface of the first mounting finger.

Elongate front drip flange 150 extends upwardly from the outer flange, generally as an extended element of inner-facing web 140.

FIG. 5 also illustrates glazing stop 56 which abuts glazing assembly 16. Glazing assembly 16 abuts front drip flange 150. Flange 150, glazing assembly 16, glazing stop 56, and mounting fingers 148A and 148B, along with frame elements 14, thus illustrate the relationships of the main elements of the window frame with the nosing and the glazing assembly.

FIG. 5 further shows a side view of an elongate window support 152 which is mounted to the bottom of window frame 14 and which extends from a location proximate mounting finger 148B toward the interior of the building to which the door frame is mounted, generally to the inner end of the door frame. A plurality of supports 152 are spread along the left-to-right width of the header jamb and support the window from the underlying door frame at header jamb 79. Spacing between supports is such as to adequately support the weight of the overlying window assembly. For e.g. a 36-inch wide half-circle transom window, three supports, each about 1 inch wide and extending the full depth of the frame behind the mounting fingers, are adequate for such support function.

In assembling the door frame, left and right side jambs are joined to a header jamb, and optionally to a threshold. In assembling the window frame, the arcuate upper frame section is assembled to the lower straight frame section.

The items illustrated in FIG. 5 are typically assembled first as a door frame and a window frame. The top of the door frame is at header jamb 79. Jamb cover 112 is assembled to jamb substrate 114. Nosing 76 is snap-locked, to the jamb cover, thus to join the nosing 76 to the door frame.

The bottom of the window assembly is at the bottom of supports 152. Nosing 20 is mounted to the window frame as illustrated in FIG. 5, with e.g. staples or other fasteners (not shown) driven through mounting fingers 148A, 148B into the wood of the window frame 14.

EXAMPLE 2

Mounting Transom Window to Door Frame

The window frame and door frame can be assembled to each other as follows. With the door frame held stationary, the window frame is positioned generally as illustrated in FIG. 5, but with the window frame juxtaposed slightly ahead of the door frame such that remote upper wall 110 is at opening 144 and remote lower wall 146 is at opening 108. Upper wall 110 is parallel with, and aligned with, opening 144. Lower wall 146 is parallel with, and aligned with, opening 108. Supports 152 are generally positioned at the upper surface of the header jamb as shown.

An e.g. manual pushing force is then engaged at the bottom of the window frame, pushing rearwardly, e.g. on nosing 20, toward fourth inner end 90 of the outer flange of nosing 76. The force required to push the window rearwardly is typically, though not necessarily, within the capability of an average adult. As the window is pushed rearwardly, remote upper wall 110 of nosing 76 becomes at least temporarily engaged in receptacle 142 of nosing 20 and remote lower wall 146 of nosing 20 becomes at least temporarily engaged in receptacle 106 of nosing 76, thus locking nosings 76 and 20 to each other as shown in FIG. 5, with the lower surface of the upper nosing 20 generally in surface-to-surface relationship with the upper surface of the lower nosing 76.

In the assembly process, the window frame is moved rearwardly until the outer-facing web 138 on nosing 20 comes into alignment with outer-facing web 94 on nosing 76, such that the two outer-facing webs form a generally common surface as illustrated.

With the nosings so joined, and with the window frame located at its desired final juxtaposition relative to the door frame, the assembly is being held together at the outwardly-facing surface of the assembly, which will face outwardly of a building to which the assembly will be joined, by the interaction of upper wall 110 and lower wall 146 in the respective receptacles. Given the restraints provided by the interactions of the upper and lower walls 110, 146, no mull cap is needed or used to hold the two nosings in the desired nearer/further e.g. vertical relationship with respect to each other. While receptacle slots could be designed into the outer webs of nosings 20 and 76, such that a mull cap could be used, no such receptacles or mull caps are needed, and normally none are employed.

By avoiding the need to use a mull cap, the cost of the mull cap element is avoided, as is the labor cost of installing the mull cap. Also, the dirt and water penetration associated with the two conventional mull cap recesses is avoided. Further, the collective design of walls 110 and 146, along with the respective receptacles, provides ease of assembly, and ease of alignment of the underlying and overlying nosings with respect to each other so as to provide a generally common surface at the front face of the assembly, namely that face which is directed outwardly from the building.

The window is further secured to the door frame header at or adjacent the inwardly-facing surfaces of the assembly. For example, a corrugated sheet fastener 147, illustrated to the right of the header jamb and the supports in FIG. 5, can be driven into the inner faces of the header 79 and supports 152 as suggested by the illustration in FIG. 5. A conventional such fastener is a corrugated metal sheet, sharpened on one corrugated end, and driven into the wood elements of header 79 and a support 152 thereby to bridge the joint between the header and the support. With a plurality of fasteners so driven while outer-facing webs 94, 138 are held in a common surface, and with the nosings joined at receptacles 106 and 142, the door frame and the window frame are securely joined to each other in permanent assembly and outer-facing webs exhibit a common surface.

Other methods of securing the window and door to each other are contemplated, such as nails and/or screws toe-nailed through the joint at the inner faces. Or screws or nails can be driven through the wood surface 154 of that portion of the jamb which faces the doorway opening, especially adjacent or under weather seal kerf 156 where such fasteners will be hidden by the weather seal.

The spacings and tolerances of the remote upper and lower walls of the nosings, and the corresponding receptacles are such that the engagements of the upper and lower walls of the respective nosings in the receptacles are substantial frictionally-restrained engagements, such that, even before the frames are further secured to each other at e.g. the inwardly-facing surfaces of the assembly, the nosings tend to remain engaged with each other under modest handling and are not generally released from each other by the action of gravity, even if the temporarily-engaged assembly is re-oriented with limited support for one or more of the door frame and/or the window frame in the assembly.

Within the same context, disengagement of the window frame and the door frame from each other is accomplished by e.g. manually pulling the base of the window frontward toward nosing 76, and tilting the window so spacing stud 141 will clear top surface 92 of nosing 76.

While the process of joining, and disengaging, the nosing and drip cap to the door frame has been described in terms of the window frame being moved relative to the the joining and disengaging of the nosing and drip cap can as well be accomplished by holding the window frame stationary and moving the door frame, or both the window frame and the door frame can be moved as part of the process of joining and/or disengaging the nosing and the drip cap.

While FIG. 5 illustrates the interface between a cladded door frame and an overlying transom window frame, the same interface, and the same assembly process, can be used to join a side-light window frame to a side jamb of a cladded door frame, including side-light frames on both side jambs of the door frame.

Figure 6:
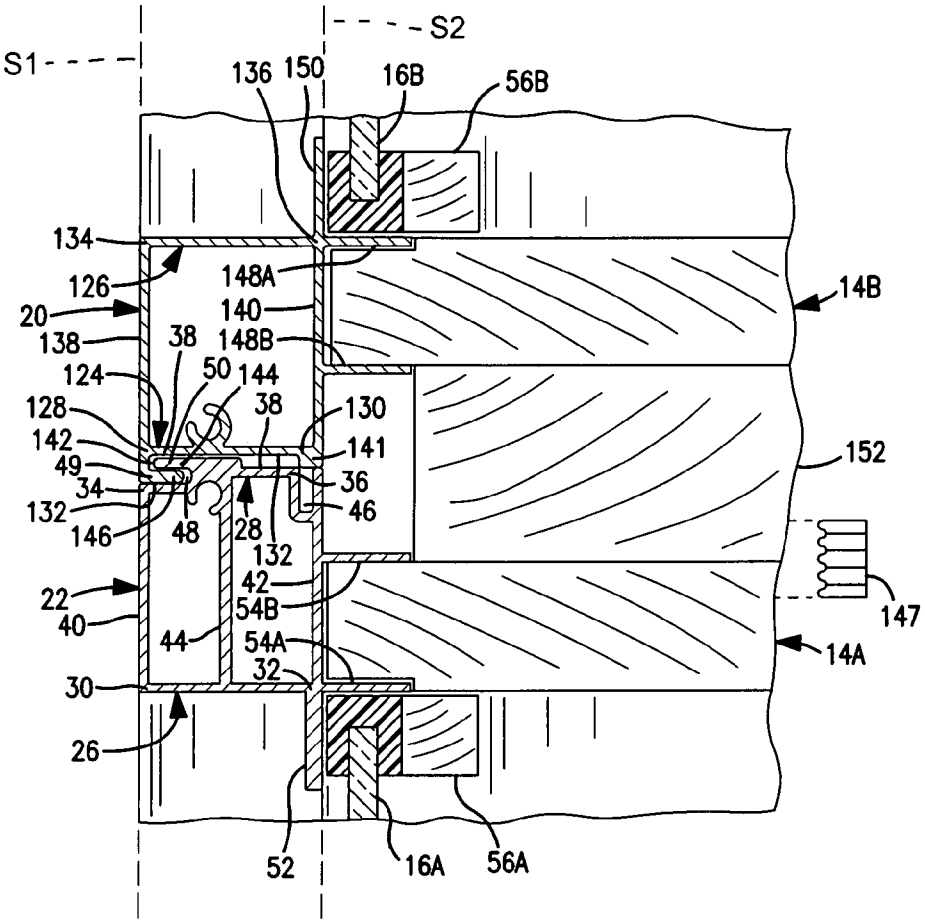
FIG. 6 shows a cross-section as in FIG. 5, but showing a horizontal joint between upper and lower windows.
Figure 7A:
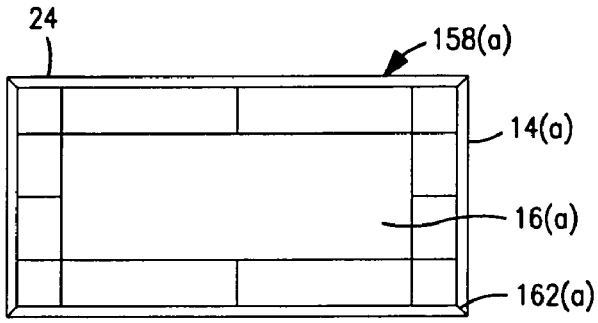
FIGS. 7(*a*)-7(*p*) show front elevation views of additional examples of shapes of windows of the invention, including windows which can be joined to each other and windows which can be joined to underlying door frames.
Figure 7B:
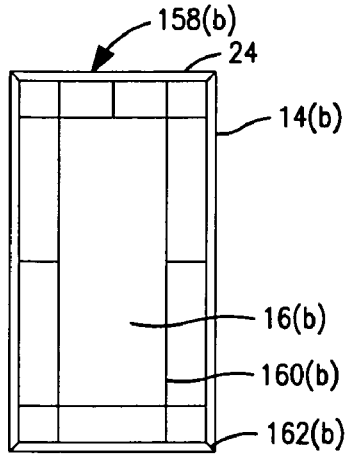
Figure 7C:
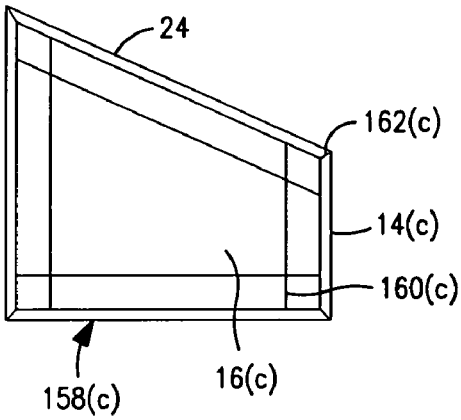
Figure 7D:
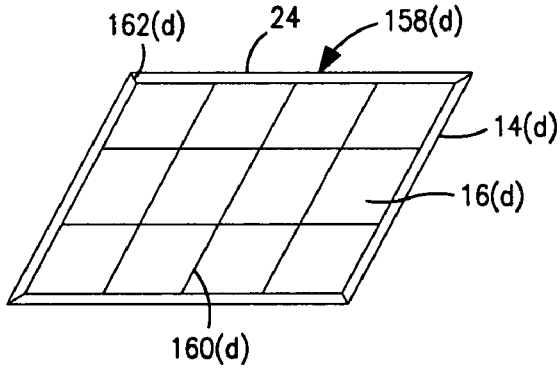
Figure 7E:
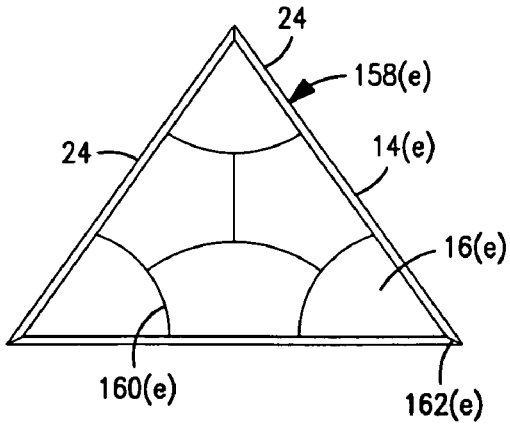
Figure 7F:
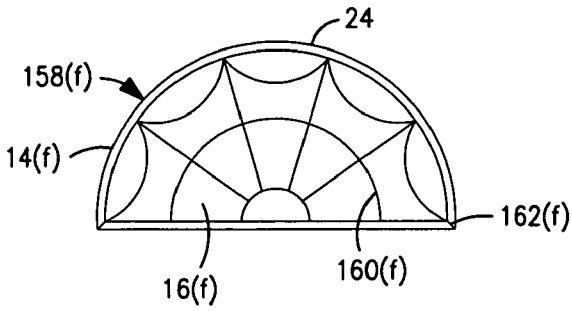
Figure 7G:
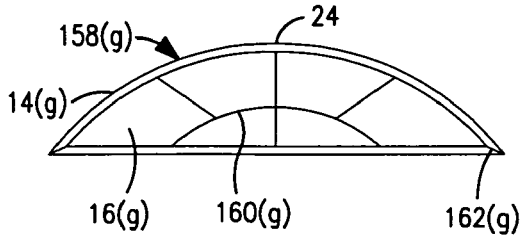
Figure 7H:
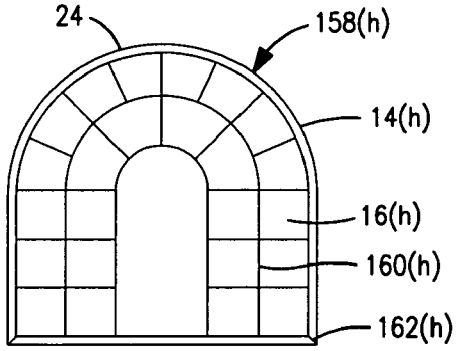
Figure 7I:
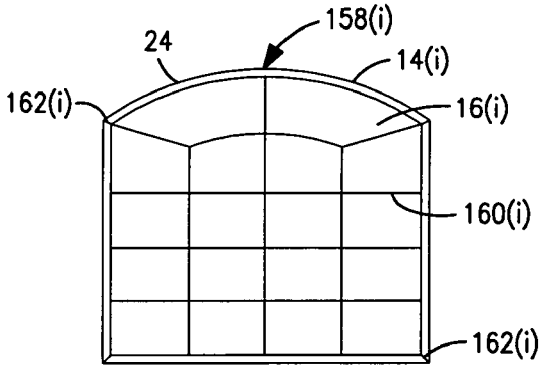
Figure 7J:
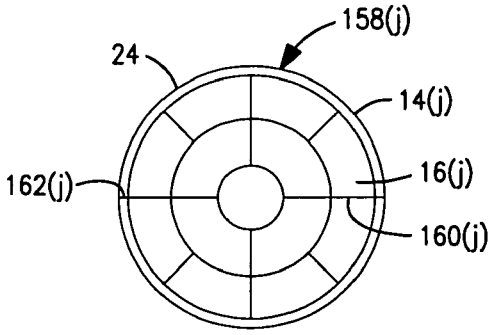
Figure 7K:
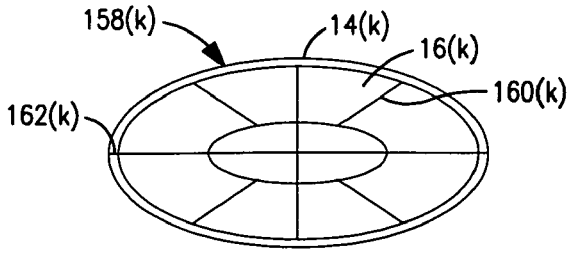
Figure 7L:
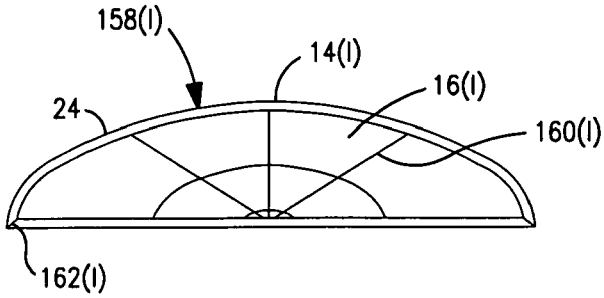
Figure 7M:
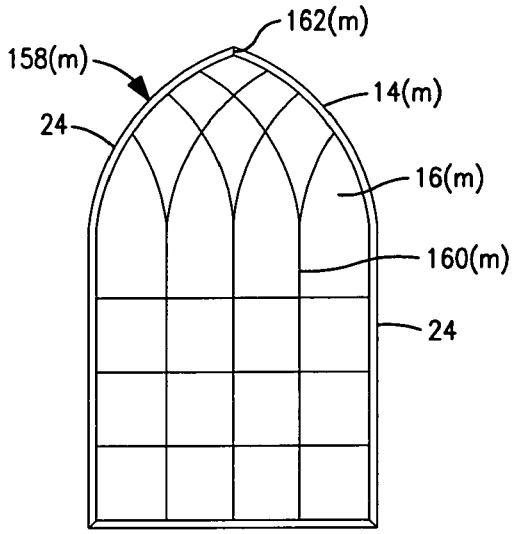
Figure 7N:
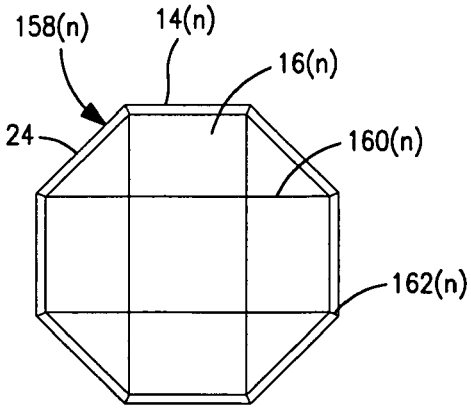
Figure 7O:
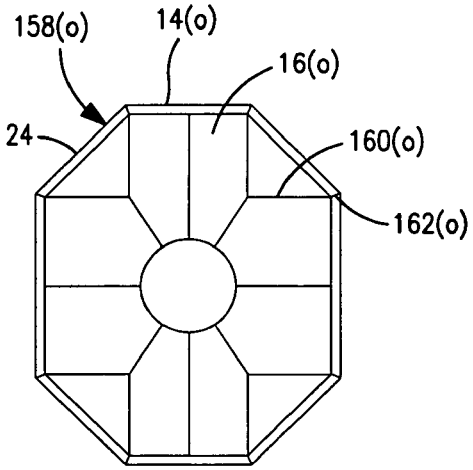
Figure 7P:
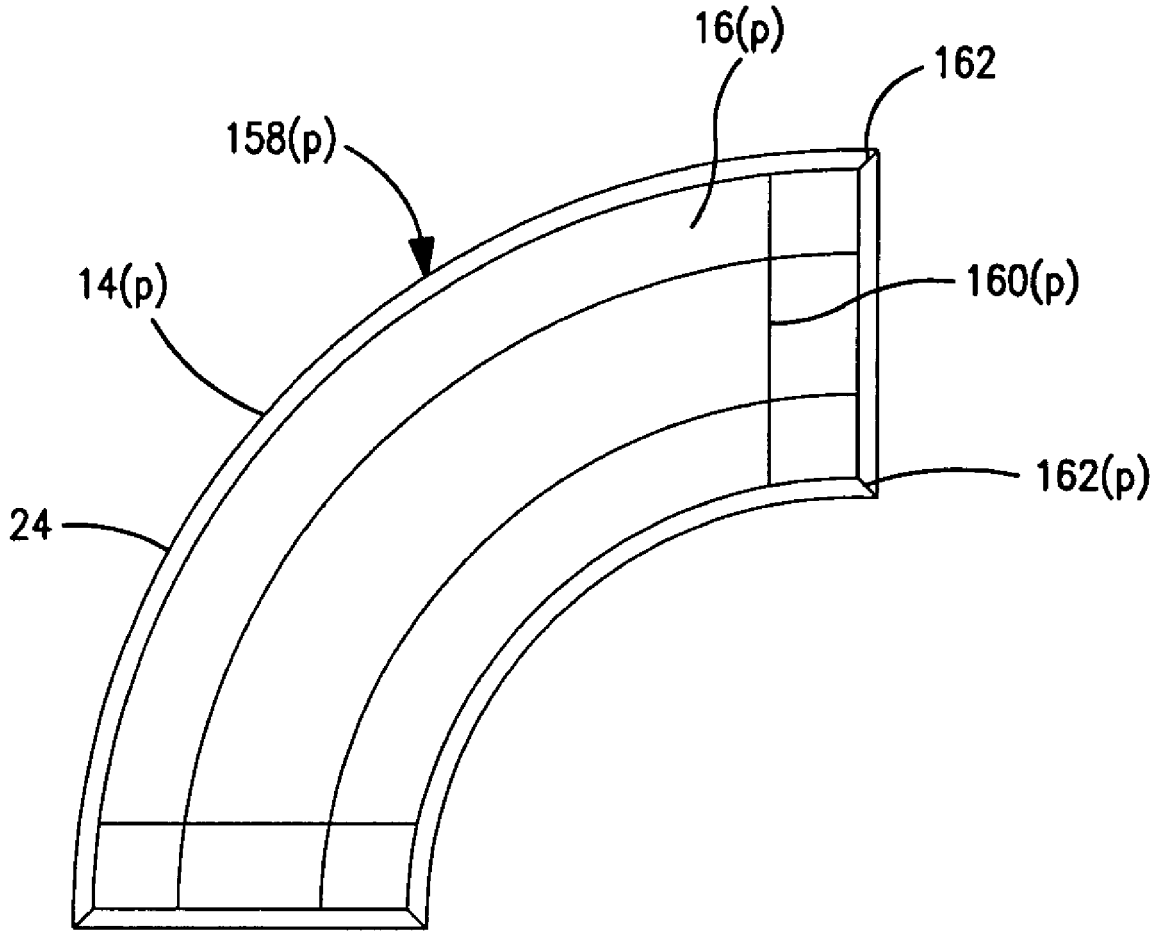

FIG. 6 illustrates the interface between first and second window frames 14A and 14B using interface structure similar to the interface structure shown in FIG. 5, but adapted to the joining of two window frames. In general, instead of using a door interface nosing 76 in combination with a window interface nosing 20 as in FIG. 5, window nosing 22 is used without bending the nosing, in combination with window nosing 20.

Thus, nosing 22 in FIG. 6 has inner flange 26, and outer flange 28 spaced from the inner flange. Inner flange 26 has first outer end 30 and second inner end 32. Outer flange 28 has third outer end 34, fourth inner end 36, and outer surface 38.

Elongate outer-facing web 40 connects to the inner and outer flanges at outer ends 30 and 34. Elongate inner-facing web 42 connects to the inner and outer flanges at inner ends 32 and 36. Elongate intermediate web 44 connects to intermediate portions of the inner and outer flanges.

Elongate stud-receiving receptacle 46, adjacent inner-facing web 42, extends downwardly and toward the inner flange, from outer surface 38 of outer flange 28.

Elongate hook-receiving receptacle 48 has an opening 49 adjacent outer end 34 of outer flange 28. The hook-receiving receptacle extends from the opening 49 toward inner-facing web 42. The hook-receiving receptacle includes a remote upper wall 50 defined between the main body of the receptacle and the upper surface 38 of the outer flange. Remote upper wall 50 of the hook receptacle is generally spaced from the remaining portions of nosing 22.

Elongate front facia flange 52 extends downwardly from inner flange 26, generally as an extended element of inner-facing web 42. In the illustrated embodiment, the front facia flange has a substantially thicker cross-section than either adjacent inner flange 26 or adjacent inner-facing web 42.

First elongate mounting finger 54A extends generally as an extension of inner flange 26 from the joinder of inner flange 26 and inner-facing web 42. Second elongate mounting finger 54B is spaced from the first mounting finger and extends from the inner-facing web away from the outer-facing web, generally parallel to first mounting finger 54A. FIG. 6 shows a portion of the window frame 14A which fits between mounting fingers 54A and 54B, including the recess cut into the frame such that the lower surface of the frame member represents a generally continuous surface with the corresponding inner-facing surface of the first mounting finger.

FIG. 6 also illustrates the glazing stop 56A which abuts glazing assembly 16A. Glazing assembly 16A abuts front facia flange 52. Flange 52, glazing assembly 16A, glazing stop 56A and frame member 14A, in combination, thus illustrate the relative positioning of the main body of the window frame, the nosing assembly, and the window glazing assembly.

Nosing 20 has inner flange 124, and outer flange 126 spaced from the inner flange. Inner flange 124 has fifth outer end 128, sixth inner end 130, and inner surface 132. Outer flange 126 has seventh outer end 134 and eighth inner end 136.

Elongate outer-facing web 138 connects to the inner and outer flanges at outer ends 128 and 134. Elongate inner-facing web 140 connects to the inner and outer flanges at inner ends 130 and 136. Elongate spacing stud 141 extends down from inner surface 132 of inner flange 124 thus to space the inner flange of nosing 20 from the outer flange of nosing 22 by a distance which maintains the inner flange of nosing 20 in a generally parallel relationship with the outer flange of nosing 22 for the full depths of nosings 20 and 22, between the inner-facing webs and the outer-facing webs.

An elongate receptacle 142 proximate fifth outer end 128 of nosing 20 has an opening 144 spaced, from outer end 128, toward the sixth inner end 130 of inner flange 124. Receptacle 142 extends from opening 144 toward outer-facing web 138. Receptacle 142 includes remote lower wall 146 defined between the main body of the receptacle and inner surface 132 of inner flange 124. Remote lower wall 146 is generally spaced from the remaining portions of nosing 20.

A first elongate mounting finger 148A extends generally as an extension of outer flange 126 from the joinder of outer flange 126 and inner-facing web 140. A second elongate mounting finger 148B is spaced from the first mounting finger and extends from the inner-facing web away from the outer-facing web. FIG. 6 shows a portion of the window frame 14B which fits between mounting fingers 148A and 148B, including a recess cut into the upper surface of the frame member such that the upper surface of the frame member represents a generally continuous surface with the corresponding outer surface of first mounting finger 148A.

Elongate front drip flange 150 extends upwardly from the outer flange, generally as an extended element of inner-facing web 140.

FIG. 6 also illustrates glazing stop 56B which abuts glazing assembly 16B. Glazing assembly 16B abuts front drip flange 150. Flange 150, glazing assembly 16B, glazing stop 56B and frame member 14B, in combination, thus illustrate the relationships of the main elements of window frame 14B with nosing 20 and glazing assembly 16B.

FIG. 6 further shows a side view of a window support 152 which is mounted to the bottom of window frame 14B, or which may, in the alternative, be mounted to a corresponding surface, e.g. top surface, of window frame 14A. A plurality of supports 152, spaced along the side-to-side widths of the windows, space window frames 14A and 14B.from each other, e.g. support overlying window frame 14B from window frame 14A. Spacing between the supports 152 is such as to adequately support the weight of the overlying window assembly. Where the joint between the window frames represents other than a horizontal orientation, supports 152 may be better described as spacers, tasked with maintaining a desired spacing between respective window frames. In such case, spacers 152 are spaced along the length of the respective side of the window frame on a given side of glazing 16A.

The items illustrated in FIG. 6 are typically assembled, first, as first and second window frames 14A and 14B, or as first and second window assemblies including glazings. Referring to the illustration in FIG. 6, the top of window frame 14A is that frame element which extends from mounting fingers 54A and 54B. The bottom of window frame 14B is the bottom surfaces of supports 152. Nosing 22 is mounted to window frame 14A as illustrated in FIG. 6. Nosing 20 is mounted to window frame 14B, also as illustrated in FIG. 6.

EXAMPLE 3

Mounting Two Window Frames to Each Other

The two window frames 14A and 14B, with nosings attached, can be assembled to each other as follows. With the lower window frame 14A held stationary, upper window frame 14B is positioned generally as illustrated in FIG. 6, but with upper window frame 14B juxtaposed slightly ahead of lower window frame 14A such that remote upper wall 50 is at opening 144 and remote lower wall 146 is at opening 49. Upper wall 50 is parallel with, and aligned with, opening 144. Lower wall 146 is parallel with, and aligned with, opening 49. Supports 152 are generally positioned at the upper surface of lower window frame 14A.

A pushing force is then engaged at the bottom of upper window frame 14B, such as at nosing 20, pushing rearwardly toward fourth inner end 36 of the outer flange of nosing 22. As the window frame is pushed rearwardly, remote upper wall 50 of nosing 22 becomes engaged in receptacle 142 of nosing 20 and remote lower wall 146 of nosing 20 becomes engaged in receptacle 48 of nosing 22, such that the terminal end portion of upper wall 50 extends toward a first imaginary plane S1 containing at least a portion of second outer-facing web 138, and the terminal end portion of lower wall 146 extends toward a second imaginary plane S2 containing at least a portion of first inner-facing web 42, thus locking nosings 22 and 20 to each other as shown in FIG. 6.

In the assembly process, the upper window frame is moved rearwardly until one of the inserts reaches the inner end of the corresponding receptacle, which serves as a stop, terminating the rearward movement of the upper window frame, whereupon the outer-facing web 138 on nosing 20 is in alignment with outer-facing web 40 on nosing 22, such that the two outer-facing webs form a generally common surface as illustrated. In such assembly process, first imaginary plane "S1" containing at least a portion of the second outer-facing web 138, and second imaginary plane "S2" containing at least a portion of the first inner-facing web 42, are moved toward each other.

The spacings and tolerances of the remote upper and lower walls and the respective receptacles are such that the engagements of the remote upper and lower walls of the respective nosings in the receptacles are substantial frictional engagements, such that the nosings tend to remain engaged with each other with modest handling and are not generally released from each other by the action of gravity, even if the temporarily-engaged assembly is re-oriented with limited support for one or more of the window frames. Within the same context, disengagement of the window frames from each other is accomplished with substantial e.g. manually-applied force urging the respective frames in a disengaging direction. Restated, while the nosings are not so loosely engaged as to easily disengage with normal handling, neither do the nosings need to be so forcefully held together that disengagement requires more than the force which can be applied manually by an average adult.

With the nosings so joined, and with the upper window frame located at its desired final juxtaposition relative to the lower window frame, the assembly is being held together at the outwardly-facing surface of the assembly, which will face outwardly of a building to which the assembly will be joined. The upper window is further secured to the lower window at or adjacent the inwardly-facing surface of the assembly by e.g. a corrugated sheet fastener 147, or by nails, or screws, all as discussed with respect to FIG. 5.

While the process of joining and disengaging the nosings has been described in terms of the upper window frame being moved relative to the lower window frame, the joining and disengaging of the nosings can as well be accomplished by holding the upper window frame stationary and moving the lower window frame, or both members can be moved as part of the joining and/or disengaging of the nosings.

Still referring to FIG. 6, the nosing 22 profile is used as the nosing on the lower window frame simply for convenience of using the same extrusion profile as was used in the arcuate nosing assembly 18 at the top of the transom window discussed with respect to FIG. 3, with exception that the nosing 22 in FIG. 6 is not bent into an arcuate configuration. Neither is the nosing in FIG. 6 assembled to an arcuate drip cap 24. Accordingly, the nosing used with the lower window frame need not have certain of the features of the arcuate nosing used at the top of the arcuate transom window frame 14. The features which can be eliminated at will are, without limitation, as follows:

Since the nosing on lower window frame 14A is not bent into an arcuate configuration, the support of intermediate web 44 is not needed, whereby intermediate web 44 becomes optional and can, as desired, be eliminated.

Also because the nosing is not bent into an arcuate configuration in the embodiments illustrated in FIG. 6, the thickness of facia flange 52 can be the same as the thicknesses of the remaining major elements of the nosing, thus about the same thickness as the thicknesses of the inner and outer flanges and/or the inner-facing web and the outer-facing web.

Since the nosing on lower window frame 14A is not joined to an arcuate drip flashing flange, FIG. 6 shows that stud receptacle 46 is not being used and can optionally, as desired, be eliminated so long as the specifications for receptacle 48, 142 and walls 50, 146 provide suitable alignment of outer facing webs 40, 138.

While window frames 14A and 14B have been illustrated as being in overlying, underlying relationship, the same elements and assembly procedures can be used in mounting window frames in a wide variety of collective configurations, thus to mount together multiple window frames/windows in an "X-Y" window matrix having essentially any number of window units in each of the "X" and "Y" directions. Thus, window assemblies can be fabricated in any desired size using a wide variety of assembly configurations, and using a wide variety of window shapes for the designs of the respective windows. Such assemblies can be fabricated in any desired configuration which can subsequently be handled safely for installation.

Any time a straight nosing is being joined to either another straight nosing or a straight drip cap, a flexible sealing compound such as caulk can optionally be spread along the interface before the nosings, or the nosing and the drip cap, are joined to each other. For example and without limitation, in the embodiments of FIG. 5 or FIG. 6, caulk can be applied in receptacle 142 of nosing 20, or on inner flange 124 of nosing 20, or on outer flange 28 of nosing 22, or outer flange 82 of nosing 76.

FIGS. 7(*a*)-7(*p*) illustrate a wide variety of shapes of windows which can be built using the nosings and drip caps, and collective assemblies of such nosings and drip caps. FIGS. 7(*a*)-7(*p*) are illustrative only, and are not exhaustive of the windows designs which can benefit from the nosing structures of the invention.

Any such window having a straight bottom side can be so-mounted to a door header jamb as a transom window. Where the bottom of the window is not straight, the lower edge of the window can be set in an adapter which adapts the lower end of the window to a straight configuration, with the nosing 20 mounted to the lower portion of the adapter.

In the alternative the upper edge of the door frame can be mounted into an adapter which adapts the upper edge of the door frame to the lower edge of the window frame. Either way, the adapter can provide the interface between window and door.

Returning now to the drawings, FIG. 7(*a*) shows a horizontally-elongate rectangular window 158(*a*) which can be used alone, in a cluster, or as a transom window 12 over a door frame. Window 158(*a*), as illustrated, includes an outer frame 14(*a*), and a glazing unit 16(*a*). Window 158(*a*) has four nosing sections which meet at four nosing joints 162(*a*) at respective corners of the window. Window 158(*a*) can be used alone or in clusters, or can be used as a transom window above a door.

A straight drip cap 24 is used with the nosing which extends the top of the window. Drip cap 24 uses e.g. a stud 74 to engage e.g. stud receptacle 46, both of which are illustrated in FIG. 3, thus to fix the inner-to-outer positioning of the drip cap relative to the nosing. Since this nosing/drip cap combination is not bent, any hook/hook receptacle combination does not provide the permanent securement of the nosing and drip cap to each other, although a hook/hook receptacle combination can provide a degree of water resistance by means of the corresponding arduous path the water would have to travel to reach wood substrate.

Since the hook/hook receptacle combination does not secure the drip cap to the nosing like in the arcuate configuration, the drip cap must be otherwise secured to the nosing. In the illustrated embodiment of e.g. FIG. 7(*a*), the drip cap is temporarily positioned at its mounting location over nosing 22. Screw holes are then drilled, at regularly-spaced intervals along the length of the drip cap, through the drip cap and into the nosing outer flange. The drip cap is then removed from the nosing and caulk is applied to the lower surface of the drip cap, at each hole. The drip cap is then re-located to its mounting location on the nosing and the screws are driven through the drip cap and into the nosing, drawing the drip cap into intimate relationship with the nosing. As the drip cap is thus drawn toward the nosing, the movement of the lower surface of the drip cap toward the upper surface of the nosing compresses the caulk whereby the caulk is spread between the lower surface of the drip cap and the upper surface of the outer flange of the nosing, including into and around the screw holes. This spreading of the caulk provides an effective weather seal around the screw holes which, along with the shielding affect of drip flange 70, prevents routine entry of air-borne/weather-borne water into the window frame at the interface of the drip cap and the nosing.

The above description illustrates that the stud and stud receptacle, in the nosing/drip cap combination, serve a positioning function when the stud is seated in the stud receptacle. Namely, the stud will seat in the stud receptacle only when the drip flashing and the nosing are properly aligned with each other. Thus, the stud/stud receptacle combination always provides certainty that the nosing and drip cap are properly aligned with each other. Thus, even where the nosing and drip cap do not need to be bent, the stud/stud receptacle combination provides a desired benefit of certainty of alignment.

In the straight assembly of e.g. FIG. 3, as described earlier herein, the hook and hook receptacle serve as no more than a temporary assembly, which can be readily disengaged. Thus, the need for screws or other fasteners spaced along the length of the drip cap in providing the permanent assembly where the nosing assembly is not arcuate/bent.

Figure 9:
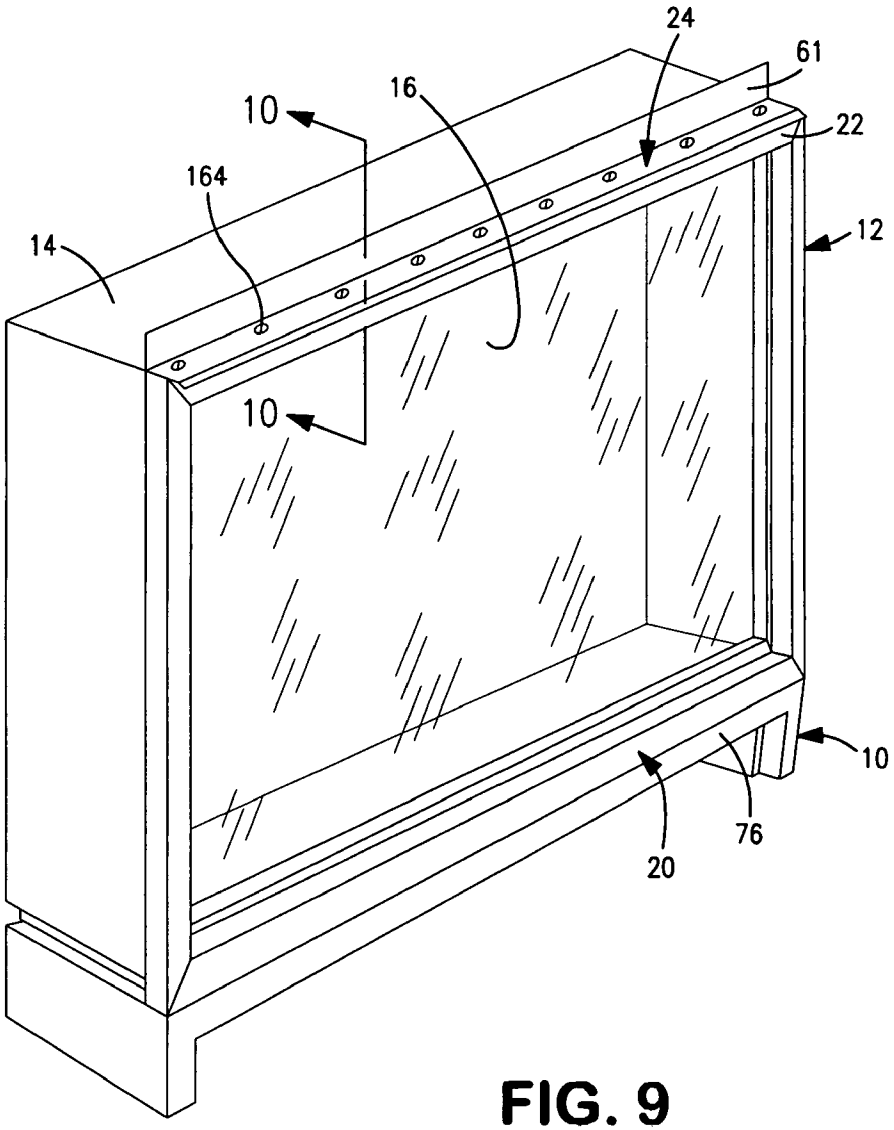
FIG. 9 shows a pictorial view as in FIG. 2, of a rectangular transom window mounted over a door frame.

In other embodiments, illustrated in FIG. 9, the stud-in-stud receptacle combination is used along with regularly-spaced screws 164 holding a straight drip cap to a straight nosing. In such embodiments, the screws hold the upper-to-lower spatial relationship while the stud holds the inner-to-outer relationship whereby the combination of a hook and a hook receptacle is optional.

FIG. 7(*b*) shows a rectangular window 158(*b*), similar to window 158(*a*) of FIG. 7(*a*), except that window 158(*b*) has been re-oriented vertically. Window 158(*b*), as illustrated, includes an outer frame 14(*b*), a glazing unit 16(*b*), and an optional decorative grid 160(*b*). In the vertical/upright orientation, window 158(*b*) can be used alone or in clusters, or can be used as a transom window above a door where the ceiling height at the doorway inside the building so allows. Window 158(*b*) has four nosing sections which meet at four nosing joints 162(*b*) at respective corners of the window. A straight drip cap 24 is assembled to the nosing which extends across the top of the window.

FIG. 7(*c*) shows a trapezoidally-shaped window 158(*c*). Window 158(*c*), as illustrated, includes an outer frame 14(*c*), a glazing unit 16(*c*), and an optional decorative grid 160(*c*). Window 158(*c*) can be used alone, in clusters, or as a transom window over a door. Window 158(*c*) has four nosing sections which meet at four nosing joints 162(*c*) at respective corners of the window. A straight drip cap 24 is assembled to the nosing which extends across the top of the window.

FIG. 7(*d*) shows a parallelogram-shaped window 158(*d*). Window 158(*d*), as illustrated, includes an outer frame 14(*d*), a glazing unit 16(*d*), and an optional decorative grid 160(*d*). Window 158(*d*) can be used alone, in clusters, or as a transom window over a door. Window 158(*d*) has four nosing sections which meet at four nosing joints 162(*d*) at respective corners of the window. A straight drip cap 24 is assembled to the nosing which extends across the top of the window.

FIG. 7(*e*) shows a triangularly-shaped window 158(*e*). Window 158(*e*), as illustrated, includes an outer frame 14(*e*), a glazing unit 16(*e*), and an optional decorative grid 160(*e*). Window 158(*e*) can be used alone, in clusters, or as a transom window over a door. Window 158(*e*) has three nosing sections which meet at three nosing joints 162(*e*) at respective corners of the window. Straight drip caps 24 are assembled to the nosings which extend from the top nosing joint to the lower left and right side nosing joints.

FIG. 7(*f*) shows a half round-shaped window 158(*f*). Window 158(*f*), as illustrated, includes an outer frame 14(*f*), a glazing unit 16(*f*), and an optional decorative grid 160(*f*). Window 158(*f*) can be used alone, in clusters, or as a transom window over a door. Window 158(*f*) has two nosing sections which meet at two nosing joints 162(*f*) at respective corners of the window. An arcuate drip cap 24 is assembled to the nosing which extends, from the two nosing joints along the arcuate top of the window.

FIG. 7(*g*) shows a circle-segment/eyebrow shaped window 158(*g*). Window 158(*g*), as illustrated, includes an outer frame 14(*g*), a glazing unit 16(*g*), and an optional decorative grid 160(*g*). Window 158(*g*) can be used alone, in clusters, or as a transom window over a door. Window 158(*g*) has two nosing sections which meet at two nosing joints 162(*g*) at lower left and right corners of the window. An arcuate drip cap 24 is assembled to the nosing which extends, from the lower left nosing joint, along the arcuate top of the window, to the lower right joint.

FIG. 7(*h*) shows a window known as a springline window 158(*h*). Window 158(*h*), as illustrated, includes an outer frame 14(*h*), a glazing unit 16(*h*), and an optional decorative grid 160(*h*). Window 158(*h*) can be used alone, in clusters, or as a transom window over a door. Window 158(*h*) has two nosing sections which meet at two nosing joints 162(*h*) at respective corners of the window. An arcuate drip cap 24 is assembled to the nosing which extends, from the lower left nosing joint, along the arcuate top of the window, to the lower right joint.

FIG. 7(*i*) shows a window 158(*i*) known as an equal leg arch window 158(*i*). Window 158(*i*), as illustrated, includes an outer frame 14(*i*), a glazing unit 16(*i*), and an optional decorative grid 160(*i*). Window 158(*i*) can be used alone, in clusters, or as a transom window over a door. Window 158(*i*) has four nosing sections which meet at four nosing joints 162(*i*) at respective corners of the window. An arcuate drip cap 24 is assembled to the nosing which extends from the upper left nosing joint, along the arcuate top of the window, to the upper right nosing joint.

FIG. 7(*j*) shows a full round window 158(*j*). Window 158(*j*), as illustrated, includes an outer frame 14(*j*), a glazing unit 16(*j*), and an optional decorative grid 160(*j*). Window 158(*j*) is typically used alone. Window 158(*j*) can have a single nosing section which encircles the entirety of the window. Optionally, window 158(*j*) has two nosing sections, a first such nosing section wrapping the top portion of the window and a second such nosing section wrapping the bottom portion of the window, thus defining first and second nosing joints 162(*j*). Window 158(*j*) is commonly used alone, but may be used in clusters with suitable adaptation framing and/or in combination with other window shapes/designs. Where upper and lower nosings are used, an arcuate drip cap 24 is assembled to the upper nosing.

FIG. 7(*k*) shows a full oval window 158(*k*). Window 158(*k*), as illustrated, includes an outer frame 14(*k*), a glazing unit 16(*k*), and an optional decorative grid 160(*k*). Window 158(*k*) is typically used alone. Window 158(*k*) can have a single nosing section which encircles the entirety of the window. Optionally, window 158(*k*) has two nosing sections, a first such nosing section wrapping the top portion of the window and a second such nosing section wrapping the bottom portion of the window, thus defining first and second nosing joints 162(*j*). Window 158(*j*) is commonly used alone, but may be used in clusters with suitable adaptation framing and/or in combination with other window shapes/designs. Where upper and lower nosings are used, an arcuate drip cap 24 is assembled to the upper nosing.

FIG. 7(*l*) shows an elliptical/oval-shaped window 158(*l*). Window 158(*l*), as illustrated, includes an outer frame 14(*l*), a glazing unit 16(*l*), and an optional decorative grid 160(*l*). Window 158(*l*) can be used alone, in clusters, or as a transom window over a door. Window 158(*l*) has two nosing sections which meet at two nosing joints 162(*l*) at respective corners of the window. An arcuate drip cap 24 is assembled to the nosing which extends, from the lower left joint, across the top of the window, to the lower right joint.

FIG. 7(*m*) shows a gothic-shaped window 158(*m*). Window 158(*m*), as illustrated, includes an outer frame 14(*m*), a glazing unit 16(*m*), and an optional decorative grid 160(*m*). Window 158(*m*) can be used alone, in clusters, or as a transom window over a door. Window 158(*m*) has three nosing sections which meet at three nosing joints 162(*m*) at respective lower left, lower right, and upper, corners of the window. First and second arcuate drip caps 24 are assembled to the nosings which extend, from the upper nosing joint, down the left and right sides of the window.

FIG. 7(*n*) shows a regular octagon window 158(*n*). Window 158(*n*), as illustrated, includes an outer frame 14(*n*), a glazing unit 16(*n*), and an optional decorative grid 160(*n*). Window 158(*n*) is typically used alone, but can be used in clusters or as a transom window over a door. Window 158(*n*) has eight nosing sections which meet at eight nosing joints 162(*n*) at respective corners of the window. First, second, and third straight drip caps 24 are assembled to the nosings which extend along the top and upper left and right sides of the window.

FIG. 7(*o*) shows an elongate octagon window 158(*o*). Window 158(*o*), as illustrated, includes an outer frame 14(*o*), a glazing unit 16(*o*), and an optional decorative grid 160(*o*). Window 158(*o*) is typically used alone, but can be used in clusters or as a transom window over a door. Window 158(*o*) has eight nosing sections which meet at eight nosing joints 162(*o*) at respective corners of the window. First, second, and third straight drip caps 24 are assembled to the nosings which extend along the top and upper left and right sides of the window.

FIG. 7(*p*) shows a quarter-circle-arc window 158(*p*). Window 158(*p*), as illustrated, includes an outer frame 14(*p*), a glazing unit 16(*p*), and an optional decorative grid 160(*p*). Window 158(*p*) is typically used alone, but can be used in combinations or as a transom window over a door. Window 158(*p*) has four nosing sections which meet at four nosing joints 162(*p*) at respective corners of the window. An arcuate drip cap 24 is assembled to the nosing which extends from the upper right nosing joint to the lower left nosing joint.

Figure 8:
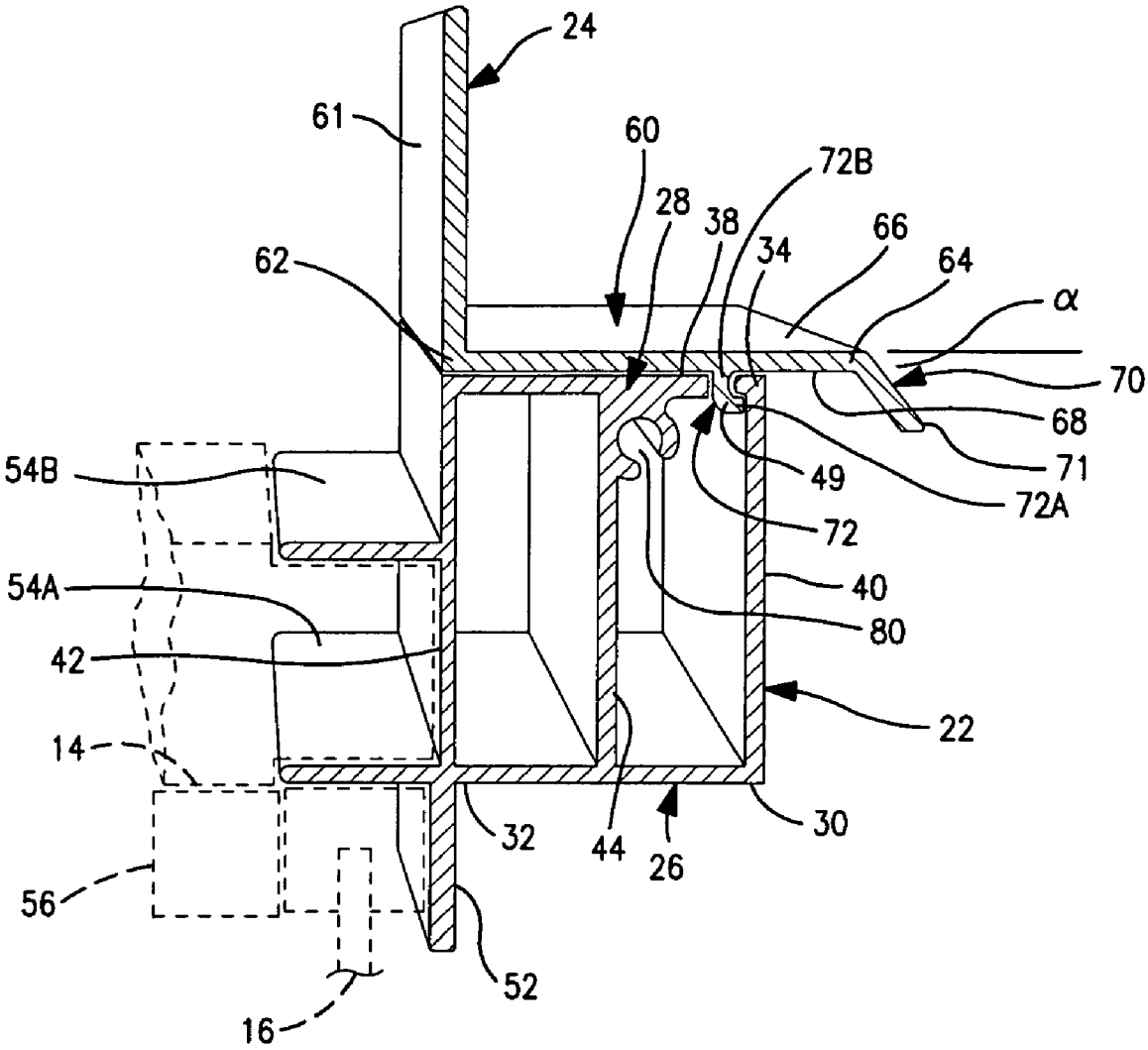
FIG. 8 shows a cross-section of a short length of a straight nosing assembly as in FIG. 3, except without any stud or stud receptacle, and with the hook receptacle opening into the outer flange of the nosing.

As seen in FIGS. 5, 6, and 8, some embodiments of the nosing assembly do not use the stud-in-stud receptacle combination. FIG. 8 illustrates a nosing assembly where both the stud and the stud receptacle have been eliminated. Hook 72 extends downwardly through a hook opening 49 in outer flange 28. Below the outer flange, hook 72 extends toward outer-facing web 40. The horizontally-extending portion 72A of the hook holds the drip cap in vertical fixation relative to the nosing. The downwardly-extending base portion 72B of the hook interfaces with the sidewalls of opening 49 thus to hold the drip cap in horizontal fixation relative to the nosing.

Drip cap 24 is assembled to nosing 22 in FIG. 8 by aligning the drip cap with the nosing, with the inner end 62 of platform 60 raised from outer surface 38 of outer flange 28. With inner end 62 so raised, the leading edge of hook 72 is aligned with opening 49, and is inserted into opening 49. As the hook progresses into opening 49, the curvature on hook 72 urges the lowering of inner end 62. By the time the hook is fully seated in opening 49 as shown in FIG. 8, inner end 62 of the platform is in general surface-to-surface relationship with outer surface 38 of the nosing, allowing for any caulk or other flexible sealing compound between such surfaces.

With the drip cap so assembled to the nosing, the interaction between the base of the hook and the sidewalls of opening 49 control/limit/prevent front-to-rear e.g. horizontal movement of the drip cap relative to the nosing. The e.g. horizontal portion of the hook controls/limits/prevents movement of the front of the drip cap relative to the nosing perpendicular to the outer surface of the nosing, but does not so limit such movement at the rear/inner portion of the drip cap. If such assembly is bent as in the embodiments of FIGS. 1, 2 and 4, the bending provides the restraint to such perpendicular movement. If the assembly is not bent, then other means such as fasteners, as are disclosed hereinafter with respect to FIG. 9, are employed toward the rear of the drip cap, e.g. adjacent inner end 62 of the platform.

FIG. 9 illustrates a straight nosing assembly, including a straight drip cap 24, mounted at the top of a rectangular e.g. transom window. Such straight drip cap can be held in horizontal, front-to-rear position relative to the nosing either by a combination of stud and stud receptacle, or by a hook 72 as illustrated in FIG. 8. Either way, in such straight configuration, screws 164 are spaced along the length of the drip cap, extending through the drip cap and into the nosing, thus providing permanent attachment of the drip cap and nosing to each other.

Figure 10:
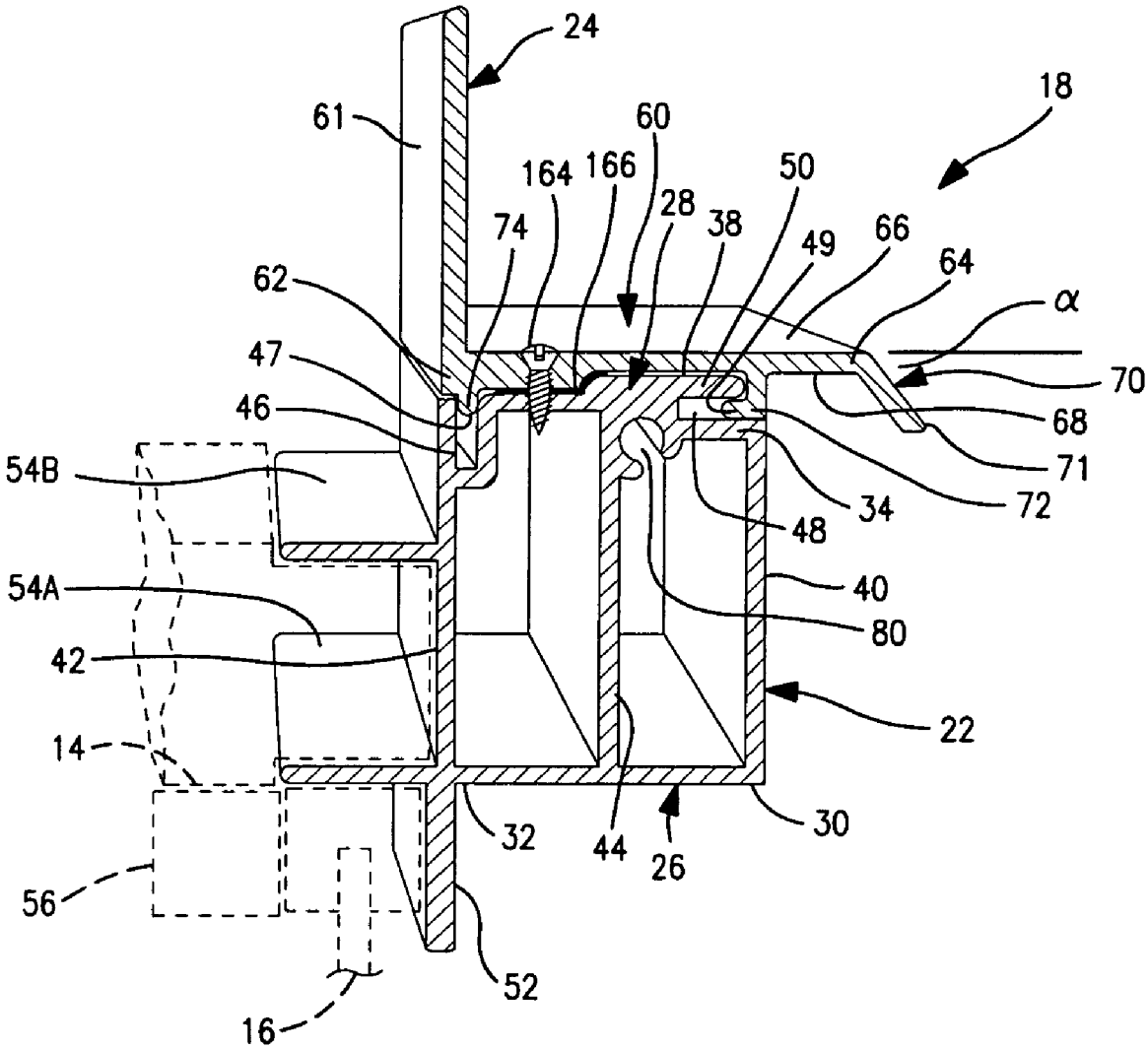
FIG. 10 is a cross-section view, taken at 10-10 in FIG. 9, showing the relationships between the screws, the drip cap, the nosing, and the caulk.

FIG. 10 shows a cross-section of the nosing assembly of FIG. 9, illustrating a screw 164 extending through the drip cap, and outer flange of the nosing. FIG. 10 also illustrates caulk 166 between lower surface 68 of the drip cap platform and outer surface 38 of the nosing outer flange. Caulk 166, where used, can be confined to the areas of the screws, thus to seal around the screws. In the alternative, caulk 166 can extend the full length of the drip cap, as well as being present at the screw holes, thus to provide a continuous barrier between the nosing outer flange and the drip cap lower surface, as well as at the screw holes. Such continuous barrier serves as a back-up barrier, backing up the barrier which is created by the convoluted path about the combination of the hook and the hook receptacle.

Joining frames together has been described herein in terms of joining a clad window frame to a clad door frame as in FIG. 5, and in terms of joining a clad window frame to a clad window frame as in FIG. 6. The same principles can be used, along with selected ones of the nosings, to similarly join a clad door frame to a clad door frame.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A method of assembling first and second frames, which represent door frames and/or window frames, to each other, the method comprising:

(a) defining a first frame comprising a first plurality of jamb elements, connected to each other, at least one of the first plurality of jamb elements on the first frame having a first outer surface, a first nosing being included on the respective at least one of the first plurality of jamb elements at the outer surface of the respective at least one of the first plurality of jamb elements, the first nosing comprising (i) a first inner flange, (ii) a first outer flange, spaced from the first inner flange, (iii) a first outer-facing web connecting to the first inner flange and to the first outer flange, (iv) a first inner-facing web connecting to the first inner flange and to the first outer flange, and (v) a first receptacle having a first opening, a first remote wall of the first receptacle defining, at least in part, a first insert;

(b) defining a second frame comprising a second plurality of jamb elements, connected to each other, at least one of the second plurality of jamb elements on the second frame having a second outer surface, a second nosing being included on the respective at least one of the second plurality of jamb elements at the outer surface of the respective at least one of the second plurality of jamb elements, the second nosing comprising (i) a second inner flange, (ii) a second outer flange, spaced from the second inner flange, (iii) a second outer-facing web connecting to the second inner flange and to the second outer flange, (iv) a second inner-facing web connecting to the second inner flange and to the second outer flange, and (v) a second receptacle having a second opening, a second remote wall of the second receptacle defining, at least in part, a second insert, one of the first and second receptacles extending from the respective first or second opening, into the respective nosing, the other one of the first and second receptacles extending from the other respective first or second opening into the respective other one of the first or second nosings;

(c) bringing the first and second frames together in such alignment that the first remote wall is proximate and generally aligned with the opening in the second receptacle and the second remote wall is proximate and generally aligned with the opening in the first receptacle; and (d) moving the first frame relative to the second frame such that the first insert enters the second receptacle and the second insert enters the first receptacle and wherein the first and second remote walls are facilitating at least temporarily assembling the first and second nosings, and correspondingly the first and second frames, to each other.

2. A method as in claim 1, the first and second frames having outer portions at the first and second nosings, and inner surfaces remote from the outer portions, further comprising, after temporarily assembling the first and second frames to each other at the nosings, fastening the first and second frames to each other at the inner surfaces.

3. In combination, a first nosing (76) and a second nosing (20), (a) said first nosing comprising (i) a first inner flange (81), (ii) a first outer flange (82), said first outer flange being spaced from said first inner flange, (iii) a first outer-facing web (94) connecting to said first inner flange and to said first outer flange, (iv) a first inner-facing web (96) connecting to said first inner flange and to said first outer flange, and (v) a first elongate receptacle (106) having a first opening (108) embodied in at least one of said first outer flange, said first outer-facing web, and said first inner-facing web, a first remote wall (110) of said first receptacle defining, at least in part, a first insert; and (b) said second nosing comprising (i) a second inner flange (124), (ii) a second outer flange (126), said second outer flange being spaced from said second inner flange, (iii) a second outer-facing web (138) connecting to said second inner flange and to said second outer flange, (iv) a second inner-facing web (140) connecting to said second inner flange and to said second outer flange, and (v) a second receptacle (142) having a second opening (144) embodied in at least one of said second inner flange, said second outer-facing web, and said second inner-facing web, a second remote wall (146) of said second receptacle defining, at least in part, a second insert, one of said first and second receptacles extending from the respective said first or second opening, into the respective said nosing and toward, but not reaching, the respective said inner-facing web, the other one of said first and second receptacles extending from the other respective said first or second opening into the respective other one of said first or second nosings, said first and second nosings being adapted to be assembled to each other with said first insert received in said second receptacle and said second insert received in said first receptacle.

4. A combination as in claim 3, said first and second nosings being assembled to each other with a frictionally-restrained engagement and wherein said assembled combination can be re-oriented without disengagement of said first and second nosings by force of gravity.

5. A combination as in claim 3 wherein, given a first imaginary plane (S1) which extends along at least a portion of said second outer-facing web, given a second imaginary plane (S2) which extends along at least a portion of said first inner-facing web, and given that the first and second imaginary planes (S1) and (S2) are parallel to each other, said first and second nosings are configured such that the process of assembling said first and second nosings to each other, includes the first and second imaginary planes (S1) and (S2) being moved toward each other.

6. A combination as in claim 3 wherein said first outer flange of said first nosing is generally in face-to-face relationship with said second inner flange of said second nosing.

7. A combination as in claim 3 wherein, when said first and second nosings are assembled to each other, with said first insert in said second receptacle and said second insert in said first receptacle, one of said first and second inserts has a terminal end portion thereof extending in a direction generally transverse to said second inner-facing web.

8. A combination as in claim 7 wherein the terminal end portion of said one of said first and second inserts extends toward an imaginary plane (S2) containing at least a portion of said first inner-facing web, and a terminal end portion of the other of said first and second inserts extends toward an imaginary plane (S1) containing at least a portion of said second outer-facing web.

9. In combination, a first nosing (76) and a second nosing (20), (a) said first nosing comprising (i) a first inner flange (81), (ii) a first outer flange (82), said first outer flange being spaced from said first inner flange, (iii) a first outer-facing web (94) connecting to said first inner flange and to said first outer flange, (iv) a first inner-facing web (96) connecting to said first inner flange and to said first outer flange, and (v) a first receptacle (106) having a first opening (108) embodied in at least one of said first outer flange, said first outer-facing web, and said first inner-facing web, a first remote wall (110) of said first receptacle defining, at least in part, a first insert; and (b) said second nosing comprising (i) a second inner flange (124), (ii) a second outer flange (126), said second outer flange being spaced from said second inner flange, (iii) a second outer-facing web (138) connecting to said second inner flange and to said second outer flange, (iv) a second inner-facing web (140) connecting to said second inner flange and to said second outer flange, and (v) a second receptacle (142) having a second opening (144) embodied in at least one of said second inner flange, said second outer-facing web, and said second inner-facing web, a second remote wall (146) of said second receptacle defining, at least in part, a second insert, said first and second nosings being adapted to be assembled to each other with said first insert received in said second receptacle and said second insert received in said first receptacle, further comprising lock structure embodied in said first inner-facing web.

10. A combination as in claim 9, said lock structure comprising first and second lock elements, further comprising an opening in said lock structure, between said first and second lock elements, such opening extending, from outside said nosing, between said first and second lock elements, to an inner space in said nosing between said inner flange and said outer flange.

11. In combination, a first nosing (76) and a second nosing (20), (a) said first nosing comprising (i) a first inner flange (81), (ii) a first outer flange (82), spaced from said first inner flange, (iii) a first outer-facing web (94) connecting to said first inner flange and to said first outer flange, (iv) a first inner-facing web (96) connecting to said first inner flange and to said first outer flange, and (v) a first receptacle (106) having a first opening (108), a first remote wall (110) of said first receptacle defining, at least in part, a first insert; and (b) said second nosing comprising (i) a second inner flange (124), (ii) a second outer flange (126), being spaced from said second inner flange, (iii) a second outer-facing web (138) connecting to said second inner flange and to said second outer flange, (iv) a second inner-facing web (140) connecting to said second inner flange and to said second outer flange, and (v) a second receptacle (142) having a second opening (144), a second remote wall (146) of said second receptacle defining, at least in part, a second insert, said first and second nosings being adapted to be assembled to each other with said first insert received in said second receptacle and said second insert received in said first receptacle, further comprising first and second mounting fingers extending from said second inner-facing web and being generally parallel to said second outer flange.

12. A combination as in claim 11, further comprising a front drip flange extending from said second outer flange, generally in line with said second inner-facing web and away from said second inner flange.

13. In combination, an elongate first nosing (76) and an elongate second nosing (20), (a) said first nosing comprising (i) a first inner flange (81), (ii) a first outer flange (82), spaced from said first inner flange, (iii) a first outer-facing web (94) connecting to said first inner flange and to said first outer flange, (iv) a first inner-facing web (96) connecting to said first inner flange and to said first outer flange, and (v) a first receptacle (106) having a first opening (108), a first remote wall (110) of said first receptacle defining, at least in part, a first insert; and (b) said second nosing comprising (i) a second inner flange (124), (ii) a second outer flange (126), spaced from said second inner flange, (iii) a second outer-facing web (138) connecting to said second inner flange and to said second outer flange, (iv) a second inner-facing web (140) connecting to said second inner flange and to said second outer flange, and (v) a second receptacle (142) having a second opening (144), a second remote wall (146) of said second receptacle defining, at least in part, a second insert, said first and second nosings being adapted to being assembled to each other with said first insert received in said second receptacle and said second insert received in said first receptacle, further comprising first and second mounting fingers extending from said first inner-facing web and being generally parallel to said first inner flange.

14. A combination as in claim 3 wherein said first and second nosings comprise extruded aluminum profiles, and wherein said first and second inner and outer flanges, said first and second inner-facing webs, and said first and second outer-facing webs have general web thicknesses of about 0.05 inch to about 0.09 inch.

15. A combination as in claim 13, further comprising a front facia flange extending from said first inner flange and away from said first outer flange, and generally aligned with said first inner-facing web.

16. A door frame assembly comprising a door frame including a plurality of door jamb elements, and a window frame including a plurality of window jamb elements, first and second nosings as in claim 3 being mounted collectively to said door frame and to said window frame, said first and second nosings being assembled to each other at said first and second receptacles.

17. A door frame assembly as in claim 16, further comprising first and second lock elements at said first inner-facing web, and an opening between said first and second lock elements, such opening extending, from outside said first nosing, between said first and second lock elements, to an inner space in said first nosing between said inner flange and said outer flange.

18. A door frame assembly as in claim 16, the first opening being embodied in the first inner-facing web, one of said door jamb elements comprising at least one of a header jamb element or a side jamb element, the respective said jamb element comprising a jamb substrate, and a jamb cover, said jamb cover comprising a main side panel covering a first surface of said jamb substrate, and a cover panel covering a second adjacent surface of said jamb substrate, said cover panel comprising locking structure extending through the first opening in said first inner-facing web and engaging said first nosing and thus mounting said first nosing to said jamb cover.

19. A door frame assembly comprising a door frame, and a window frame mounted to said door frame, (a) said door frame comprising a left side door jamb element, a right side door jamb element, and a header door jamb element, said left and right side door jamb element being mounted to said header door jamb element, at least one of said left side door jamb element, said right side door jamb element, and said header door jamb element having an outer surface, a first nosing being included on the respective said at least one door jamb element at the outer surface, said first nosing comprising (i) a an first inner flange, (ii) a first outer flange, spaced from said first inner flange, (iii) a first outer-facing web connecting to said first inner flange and to said first outer flange, (iv) a first inner-facing web connecting to said first inner flange and to said first outer flange, and (v) a first receptacle having a first opening a first remote wall of said first receptacle defining, at least in part, a first insert;

(b) said window frame comprising a plurality of window jamb elements, connected to each other, at least one second nosing being included on at least one of said plurality of window jamb elements, said second nosing comprising (i) a second inner flange, (ii) a second outer flange, spaced from said second inner flange, (iii) a second outer-facing web connecting to said second inner flange and to said second outer flange, (iv) a second inner-facing web connecting to said second inner flange and to said second outer flange, and (v) a second receptacle having a second opening, a second remote wall of said second receptacle defining, at least in part, a second insert, one of said first and second receptacles extending from the respective said first or second opening, into the respective said nosing and toward the respective said inner-facing web, the other one of said first and second receptacles extending from the other respective said first or second opening into the respective other one of said first or second nosings and toward the respective said first or second outer-facing web, said first and second nosings being engaged with each other, thereby at least temporarily mounting said window frame and said door frame to each other.

20. A door frame assembly as in claim 19, said first and second nosings being assembled to each other with a frictionally-restrained engagement wherein such assembled combination can be re-oriented, with limited support to such assembly, without disengagement of said first and second nosings by force of gravity.

21. A door frame assembly as in claim 20, further comprising first and second mounting fingers extending from said second inner-facing web and extending away from said second outer-facing web.

22. A door frame assembly as in claim 21, a drip flange extending from said second outer flange, and generally parallel to said second outer flange and away from said second inner-facing flange.

23. A door frame assembly as in claim 19 wherein said first insert is in said second receptacle and said second insert is in said first receptacle.

24. A door frame assembly as in claim 23, at least one of said first and second nosings defining a stop, including a stop location, with respect to the other of said first and second nosings, said first and second nosings, when assembled to each other, to the stop location provided by such stop, presenting said first and second outer-facing webs as a generally continuous surface.

25. A door frame assembly as in claim 19 wherein said first outer flange of said first nosing is in face-to-face relationship with said second inner flange of said second nosing.

26. A door frame assembly as in claim 19 wherein said first and second nosings comprise extruded aluminum profiles, and wherein said first and second inner and outer flanges, said first and second inner-facing webs, and said first and second outer-facing webs have general web thicknesses of about 0.05 inch to about 0.09 inch.

27. A door frame assembly as in claim 19, further comprising first and second lock elements at said first inner-facing web, and an opening between said first and second lock elements, such opening extending, from outside said first nosing, between said first and second lock elements, to an inner space in said first nosing between said inner flange and said outer flange.

28. A door frame assembly as in claim 27, the respective said door jamb element to which said first nosing is mounted comprising a jamb substrate, and a jamb cover covering first and second surfaces of the respective said jamb substrate, said jamb cover comprising a main side panel and a cover panel, said cover panel comprising third and fourth lock elements extending through the opening in said first inner-facing web and engaging said first and second lock elements and thus mounting said first nosing to the respective said jamb cover, and to the respective said jamb.

29. A frame assembly adapted to be mounted in a rough opening in a building, said frame assembly comprising a first frame and a second frame, (a) said first frame comprising a first plurality of jamb elements, connected to each other, at least one of said first plurality of jamb elements on said first frame having a first outer surface, at least one first nosing being included on the respective said at least one first jamb element at the outer surface of the respective said at least one first jamb element, said first nosing comprising (i) a first inner flange, (ii) a first outer flange, spaced from said first inner flange, (iii) a first outer-facing web connecting to said first inner flange and to said first outer flange, (iv) a first inner-facing web connecting to said first inner flange and to said first outer flange, and (v) a first receptacle having a first opening, a first remote wall of said first receptacle defining, at least in part, a first insert; and (b) said second frame comprising a second plurality of jamb elements, connected to each other, at least one of said second plurality of jamb elements on said second frame having a second outer surface, at least one second nosing being included on the respective said at least one second jamb element at the outer surface of the respective said at least one second jamb element, said second nosing comprising (i) a second inner flange, (ii) a second outer flange, spaced from said second inner flange, (iii) a second outer-facing web connecting to said second inner flange and to said second outer flange, (iv) a second inner-facing web connecting to said second inner flange and to said second outer flange, and (v) a second receptacle having a second opening, a second remote wall of said second receptacle defining, at least in part, a second insert, one of said first and second receptacles extending from the respective said first or second opening, into the respective said nosing and toward the respective said inner-facing web, the other one of said first and second receptacles extending from the other respective said first or second opening into the respective other one of said first or second nosings and toward the respective said first or second outer-facing web, said first and second nosings being engaged with each other, thereby at least temporarily mounting said first and second frames to each other.

30. A frame assembly as in claim 29, said first and second nosings being assembled to each other with a frictionally-restrained engagement wherein such assembled combination can be re-oriented, with limited support to such assembly, without disengagement of said first and second nosings by force of gravity.

31. A frame assembly as in claim 29 wherein said first insert is in said second receptacle and said second insert is in said first receptacle.

32. A frame assembly as in claim 31, at least one of said first and second nosings defining a stop, including a stop location, with respect to the other of said first and second nosings, said first and second nosings, when assembled to each other, to the stop location provided by such stop, presenting said first and second outer-facing webs as a generally continuous surface.

33. A frame assembly as in claim 29 wherein said first outer flange of said first nosing is generally in face-to-face relationship with said second inner flange of said second nosing.

34. A frame assembly as in claim 29, further comprising first and second mounting fingers extending from said second inner-facing web and being generally parallel to said second outer flange and extending away from said second outer-facing web.

35. A frame assembly as in claim 29 wherein said first and second nosings comprise extruded aluminum profiles, and wherein said first and second inner and outer flanges, said first and second inner-facing webs, and said first and second outer-facing webs have general web thicknesses of about 0.05 inch to about 0.09 inch.

36. A frame assembly adapted to be mounted in a rough opening in a building, said frame assembly comprising a first frame and a second frame, (a) said first frame comprising a first plurality of jamb elements, connected to each other, at least one of said first plurality of jamb elements having a first outer surface, at least one first nosing being included on the respective said at least one first jamb element, said first nosing comprising at least one first flange or web, and a first receptacle having a first opening embodied in the at least one first flange or web, a first remote wall of said first receptacle defining, at least in part, a first insert; and (b) said second frame comprising a second plurality of jamb elements, connected to each other, at least one of said second plurality of jamb elements having a second outer surface, at least one second nosing being included on the respective said at least one second jamb element, said second nosing comprising at least one flange or web, and a second receptacle having a second opening embodied in the at least one second flange or web, and a second remote wall of said second receptacle defining, at least in part, a second insert, one of said first and second receptacles extending from the respective said first or second opening, into the respective said nosing and toward, but not reaching, a respective said flange or web, the other one of said first and second receptacles extending from the other respective said first or second opening into the respective other one of said first or second nosings, said first insert being engaged in said second receptacle and said second insert being engaged in said first receptacle, said first and second nosings thereby at least temporarily mounting said first and second frames to each other.

* * * * *

UNITED STATES PATENT AND TRADEMARK OFFICE

CERTIFICATE OF CORRECTION

PATENT NO. : 8,347,586 B2
APPLICATION NO. : 12/590375
DATED : January 8, 2013
INVENTOR(S) : Gary L. Boldt It is certified that error appears in the above-identified patent and that said Letters Patent is hereby corrected as shown below:

In the Specifications

In column 17, line 15, remove “the” between “relative to” and “the joining”.

In column 18, line 58, remove the “.” after “14B”.

In column 23, line 49, replace “162(j)” with --162(k)--.

In column 23, line 49, replace “158(j)” with --158(k)--.

Signed and Sealed this
Eleventh Day of June, 2013

Teresa Stanek Rea
*Acting Director of the United States Patent and Trademark Office*